US007406755B2

(12) United States Patent
Putnam et al.

(10) Patent No.: US 7,406,755 B2
(45) Date of Patent: Aug. 5, 2008

(54) HYDROENTANGLEMENT OF CONTINUOUS POLYMER FILAMENTS

(75) Inventors: Michael Putnam, Fuquay-Varina, NC (US); Richard Ferencz, Isle of Palms, SC (US); Marlene Storzer, Cornelius, NC (US); Jian Weng, Charlotte, NC (US)

(73) Assignee: Polymer Group, Inc., Charlotte, NC (US)

( * ) Notice: Subject to any disclaimer, the term of this patent is extended or adjusted under 35 U.S.C. 154(b) by 450 days.

(21) Appl. No.: 11/101,817

(22) Filed: Apr. 7, 2005

(65) Prior Publication Data

US 2005/0202744 A1 Sep. 15, 2005

Related U.S. Application Data

(60) Division of application No. 09/475,544, filed on Dec. 30, 1999, now Pat. No. 6,903,034, which is a continuation-in-part of application No. 09/287,673, filed on Apr. 7, 1999, now Pat. No. 7,091,140.

(51) Int. Cl.
*D04H 3/10* (2006.01)

(52) U.S. Cl. ..... 28/104; 28/167; 156/148

(58) Field of Classification Search ..... 28/104, 28/105, 167, 106, 103, 107, 112, 168; 156/148, 156/344, 155, 181, 167, 269, 308.2, 308.4; 442/382, 384, 401, 408; 428/198
See application file for complete search history.

(56) References Cited

U.S. PATENT DOCUMENTS 4,329,763 A * 5/1982 Alexander et al. ..... 28/104
4,741,075 A * 5/1988 Taguchi et al. ..... 28/104
4,879,170 A * 11/1989 Radwanski et al. ..... 442/329
4,920,001 A * 4/1990 Lee et al. ..... 442/114
4,935,295 A * 6/1990 Serafini ..... 156/148
4,939,016 A * 7/1990 Radwanski et al. ..... 28/104
5,023,130 A * 6/1991 Simpson et al. ..... 28/104
5,240,764 A * 8/1993 Haid et al. ..... 28/104
5,256,224 A * 10/1993 Gillyns et al. ..... 156/148
5,913,993 A * 6/1999 Ortega et al. ..... 156/167
5,983,469 A * 11/1999 Beaty et al. ..... 28/167
6,200,669 B1 * 3/2001 Marmon et al. ..... 428/198
6,715,189 B2 * 4/2004 Osbon et al. ..... 28/167

* cited by examiner

*Primary Examiner*—Amy B Vanatta
(74) *Attorney, Agent, or Firm*—Wood, Phillips, Katz, Clark & Mortimer

(57) ABSTRACT

A nonwoven fabric comprises continuous polymer filaments of 0.5 to 3 denier that have been hydroentangled in a complex matrix for interconnecting filament loops, and that is otherwise substantially free of knotting, or of otherwise wrapping about one another. A process for making a nonwoven fabric comprises continuously extruding polymer filaments of 0.5 to 3 denier onto a moving support, pre-entangling the filaments with water jets, and entangling the filaments with a second set of water jets on a three-dimensional image transfer device. An apparatus for making a nonwoven fabric comprises means for continuously extruding substantially endless polymer filaments of 0.5 to 3 denier onto a moving support to form an unbonded web, a pre-entangling station for entangling the web with a plurality of water jets, and a plurality of water jets for final entanglement of the filament web on a three-dimensional image transfer device. In another aspect of the present invention, plural precursor webs, each comprising polymeric filaments, can be employed to form a laminated nonwoven fabric.

20 Claims, 19 Drawing Sheets

FIG. 8: Prior Art
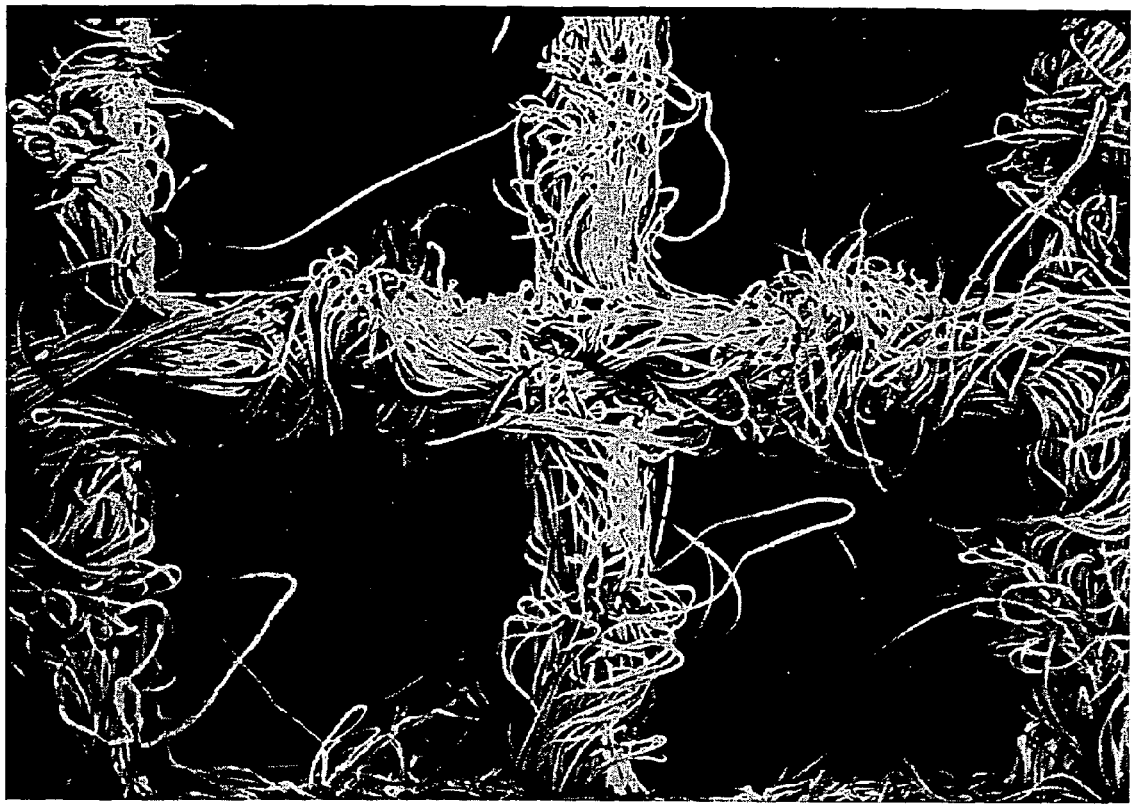

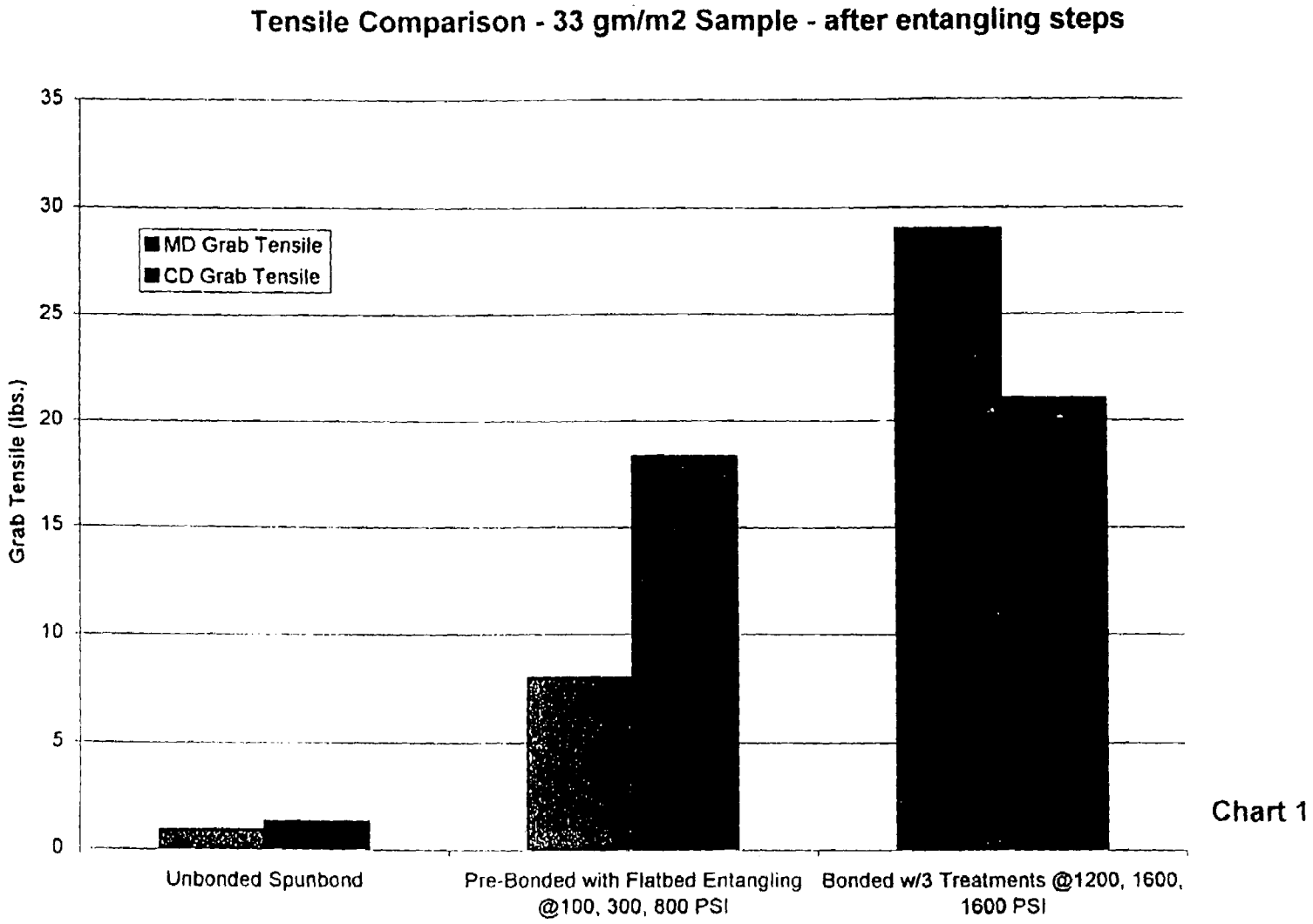
Chart 1

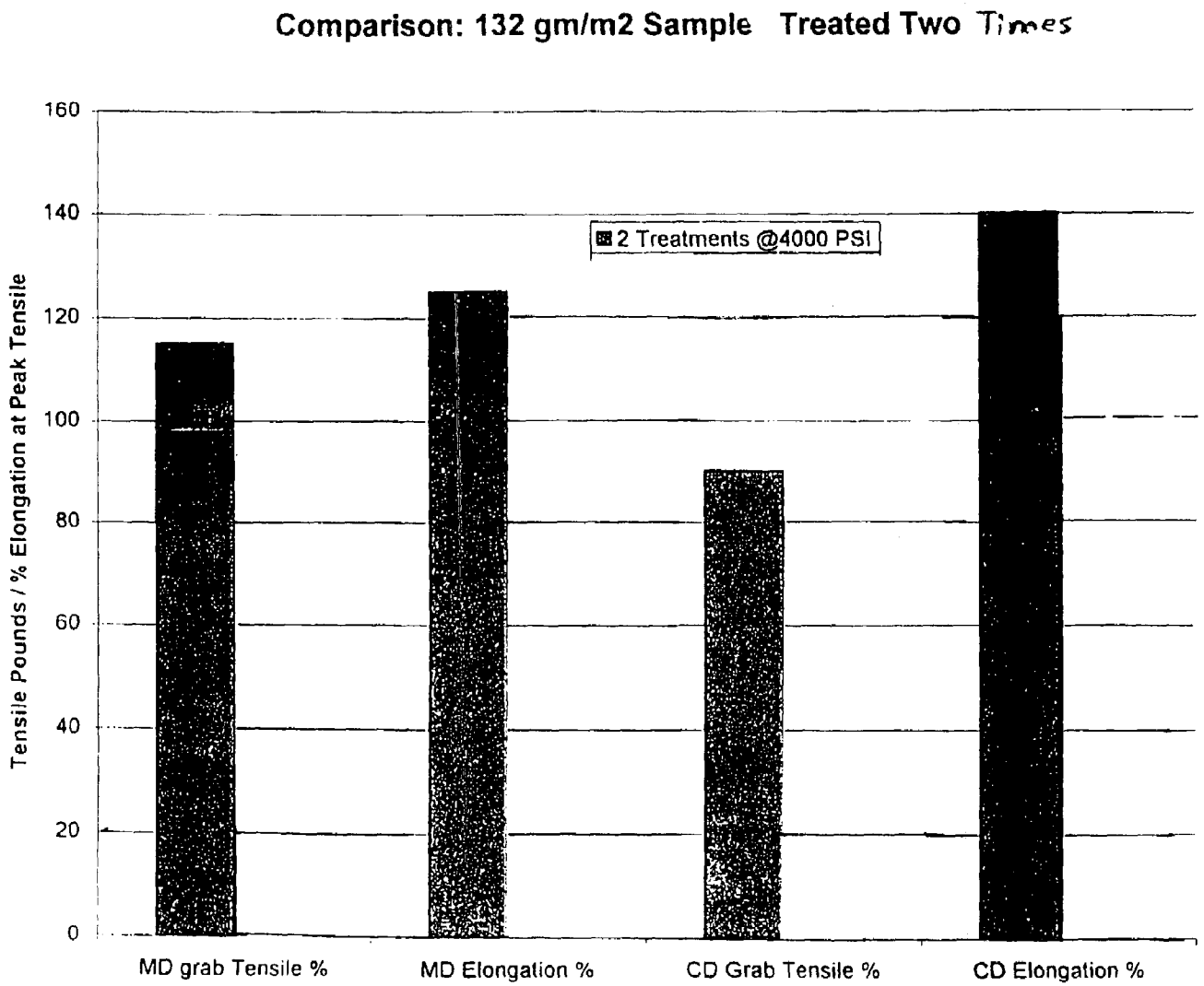
Chart 2

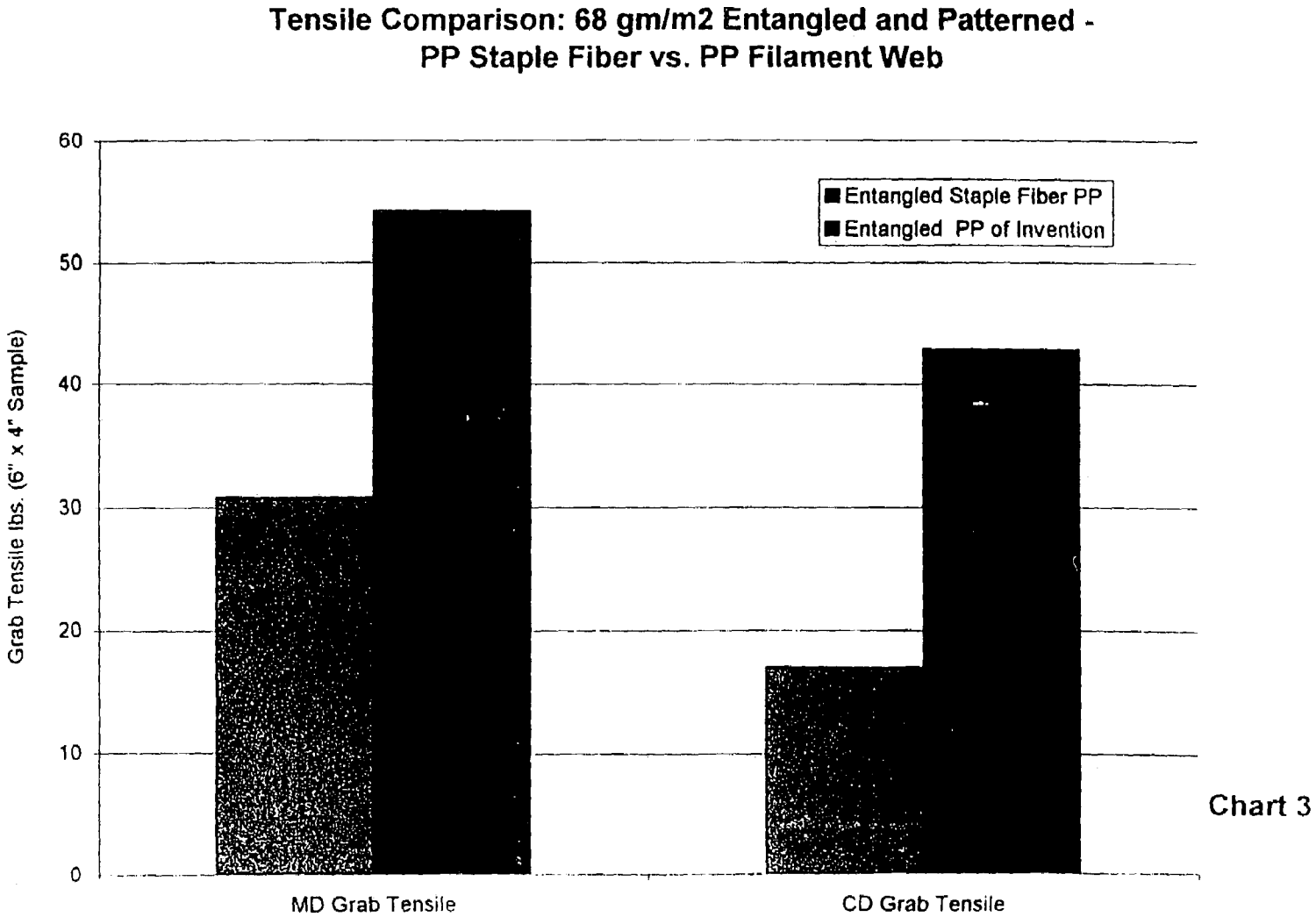
Tensile Comparison: 68 gm/m2 Entangled and Patterned - PP Staple Fiber vs. PP Filament Web
Entangled Staple Fiber PP
Entangled PP of Invention
Grab Tensile lbs. (6" x 4" Sample)
60
50
40
30
20
10
0
MD Grab Tensile
CD Grab Tensile
Chart 3

TABLE 1

| ID | type | basis weight | denier | water jets process/pattern | jet pressures 1.00 | 2.00 | 3.00 | 4.00 | 5.00 | 6.00 | total energy HP-hr/lb. | Entanglement completeness | Entanglement frequency | Fiber interlock | Grab Tensile CD | Grab Tensile MD | Trap Tear CD | Trap Tear MD | Abrasion cycles | Strip Tensile, # CD | Strip Tensile, # MD | Elongation CD | Elongation MD | Density g/cm^3 |
|---|---|---|---|---|---|---|---|---|---|---|---|---|---|---|---|---|---|---|---|---|---|---|---|---|
| W | TBCW | 34.00 | 2.20 | | | | | | | | | 1.04 | 45.43 | 9.66 | 10.00 | 22.00 | 3.00 | 9.00 | 54.00 | 1.00 | 5.00 | 58.00 | 49.00 | 0.14 |
| X | TBCW | 68.00 | 2.20 | | | | | | | | | 0.98 | 52.03 | 19.15 | 25.00 | 37.00 | 7.00 | 15.00 | 18.00 | 4.00 | 7.00 | 52.00 | 51.00 | 0.45 |
| 108 | Spinlace | 34.00 | 1.67 | flatbed & roll * | 100 | 1200 | 1200 | 800 | 1600 | 1600 | 1.10 | 0.85 | 34.40 | 46.29 | 29.00 | 50.00 | 16.00 | 25.00 | 40.00 | 4.00 | 13.00 | 118.00 | 117.00 | 0.06 |
| 401A | Spinlace | 34.00 | 1.67 | Apex 33x28 | | | | | | | 1.60 | 1.17 | 11.86 | 45.22 | | | | | | 2.90 | 4.90 | | | 0.06 |
| 103 | Spinlace | 68.00 | 1.67 | flatbed & roll * | 100 | 1600 | 1600 | 1600 | 1600 | 1600 | 0.70 | 1.18 | 9.72 | 40.42 | 81.00 | 116.00 | 34.00 | 55.00 | 5.00 | 6.00 | 14.00 | 137.00 | 120.00 | 0.17 |
| 402A | Spinlace | 68.00 | 1.67 | tricot sleeve | | | | | | | 1.90 | 1.10 | 9.91 | 41.30 | | | | | | 5.80 | 6.60 | | | 0.08 |
| 102 | Spinlace | 68.00 | 3.00 | flatbed & roll * | 100 | 1600 | 1600 | 1600 | 1600 | 1600 | 0.70 | 1.18 | 12.46 | 21.34 | | | | | | 2.10 | 4.00 | | | 0.06 |
| 402C | Spinlace | 68.00 | 3.00 | tricot sleeve | | | | | | | 1.90 | 1.10 | 13.38 | 35.13 | | | | | | 2.40 | 8.20 | | | 0.05 |
| 302 | Spinlace | 100.00 | 3.00 | flatbed & roll * | 100 | 1600 | 1700 | 1700 | 1700 | 1700 | 0.50 | 1.12 | 13.91 | 19.70 | | | | | | 4.37 | 5.80 | | | 0.07 |
| Y | SB | 34.00 | 1.67 | | | | | | | | | 0.98 | 103.89 | 37.33 | 24.00 | 47.00 | 4.00 | 9.00 | 36.00 | 3.00 | 10.00 | 39.00 | 37.00 | 0.15 |
| Z | SB | 68.00 | 1.67 | | | | | | | | | 0.79 | 26.36 | 32.46 | 32.00 | 51.00 | 14.00 | 24.00 | 10.00 | 3.00 | 8.00 | 33.00 | 20.00 | 0.52 |
| 201 | HET | 34.00 | 2.20 | flatbed & roll * | 100 | 600 | 1200 | 800 | 1600 | 1600 | | 0.58 | 19.07 | 17.42 | 10.00 | 20.00 | 5.00 | 11.00 | 28.00 | 1.00 | 5.00 | 127.00 | 103.00 | 0.05 |
| 401B | HET | 34.00 | 2.20 | Apex 33x28 | | | | | | | | 1.15 | 15.33 | 21.09 | | | | | | 1.01 | 2.35 | | | 0.06 |
| 204 | HET | 68.00 | 2.20 | flatbed & roll * | 100 | 600 | 1200 | 1600 | 1600 | 1600 | | 0.96 | 17.45 | 22.21 | 42.00 | 56.00 | 6.00 | 16.00 | 5.00 | 3.00 | 8.00 | 128.00 | 111.00 | 0.18 |
| 402B | HET | 68.00 | 2.20 | tricot sleeve | | | | | | | | 1.13 | 19.54 | 25.93 | | | | | | 2.90 | 3.80 | | | 0.06 |

notes: TBCW = thermally point bonded carded webs
Spinlace = water jet entangled continuous filament webs
SB = thermally point bonde spunbond
HET = hydroentangled carded staple fiber webs

HYDROENTANGLEMENT OF CONTINUOUS POLYMER FILAMENTS

CROSS REFERENCE TO RELATED APPLICATIONS

The present application is a division of U.S. patent application Ser. No. 09/475,544 filed Dec. 30, 1999 now U.S. Pat. No. 6,903,034, which is a Continuation-In-Part of U.S. Ser. No. 09/287,673, filed Apr. 7, 1999 now U.S. Pat. No. 7,091, 140.

TECHNICAL FIELD

The present invention relates generally to a method for hydroentanglement of continuously extruded, essentially endless thermoplastic polymer filaments, the apparatus for carrying out the method, and products produced thereby. The polymeric filaments can be provided in the form of one or more spunbonded precursor webs, or the process can be practiced in-line with an associated spunbonding apparatus. Fabrics embodying the present invention may comprise laminations of differing polymeric filaments, such as filaments exhibiting significantly differing bonding temperatures. Additionally, fabrics having relatively high basis weights can be formed from plural spunbond precursor webs

BACKGROUND OF THE INVENTION

Nonwoven fabrics are used in a wide variety of applications, where the engineered qualities of the fabrics can be advantageously employed. These types of fabrics differ from traditional woven or knitted fabrics in that the fibers or filaments of the fabric are integrated into a coherent web without traditional textile processes. Entanglement of the fibers or filaments of the fabric provide the fabric with the desired integrity, with the selected entanglement process permitting fabrics to be patterned to achieve desired aesthetics, and physical characteristics.

The term "hydroentanglement" generally refers to a process that was developed as a possible substitute for a conventional weaving process. In a hydroentanglement process, small, high intensity jets of water are impinged on a layer of loose fibers or filaments, with the fibers or filaments being supported on an unyielding perforated surface, such as a wire screen or perforated drum. The liquid jets cause the fibers, being relatively short and having loose ends, to become rearranged, with at least some portions of the fibers becoming tangled, wrapped, and/or knotted around each other. Depending on the nature of the support surface being used (e.g., the size, shape and pattern of openings), a variety of fabric arrangements and appearances can be produced, such as a fabric resembling a woven cloth or a lace.

The term "spunbonding" refers to a process in which a thermoplastic polymer is provided in a raw or pellet form and is melted and extruded or "spun" through a large number of small orifices to produce a bundle of continuous or essentially endless filaments. These filaments are cooled and drawn or attenuated and are deposited as a loose web onto a moving conveyor. The filaments are then partially bonded, typically by passing the web between a pair of heated rolls, with at least one of the rolls having a raised pattern to provide a bonding pattern in the fabric. Of the various processes employed to produce nonwovens, spunbonding is the most efficient, since the final fabric is made directly from the raw material on a single production line. For nonwovens made of fibers, for example, the fibers must be first produced, cut, and formed into bales. The bales of fibers are then processed and the fibers are formed into uniform webs, usually by carding, and are then bonded to make a fabric.

Hydroentangled nonwoven fabrics enjoy considerable commercial success primarily because of the variety of fiber compositions, basis weights, and surface textures and finishes which can be produced. Since the fibers in the fabric are held together by knotting or mechanical friction, however, rather than by fiber-to-fiber fusion or chemical adhesion, such fabrics offer relatively low tensile strength and poor elongation. In order to overcome these problems, proposals have been advanced to entangle the fibers into an already existing separate, more stable substrate, such as a preformed cloth or array of filaments, where the fibers tend to wrap around the substrate and bridge openings in the separate substrate. Such processes obviously involve the addition of a secondary fabric to the product, thereby increasing the associated effort and cost.

Another method for improving strength properties is to impregnate the fabric with adhesive, usually by dipping the fabric into an adhesive bath with subsequent drying of the fabric. In addition to adding cost and effort to the process, however, addition of an adhesive may undesirably affect other properties of the final product. For instance, treatment with an adhesive may affect the affinity of the web for a dye, or may otherwise cause a decline in aesthetic properties such as hand and drape as a result of increased stiffness.

Because of the above discussed problems associated with hydroentangled webs, the hydroentangling practice as known by those skilled in the art heretofore has been principally limited only to staple fibers, to prebonded webs, or to filaments of only an extremely small diameter. The hydroentanglement of webs of filaments that are continuous, of relatively large diameter, or higher denier has heretofore not been considered feasible. Conventional wisdom suggests that long, large diameter, continuous filaments would dissipate energy supplied by entangling water jets, and thereby resist entanglement. An additional factor suggesting that continuous filaments could not be sufficiently hydroentangled to form a stable, cohesive fabric is that as the filaments are continuous they do not have loose free ends required for wrapping and knotting. Yet another problem in the hydroentangling process as presently known and practiced in the industry is associated with production speed limitations. Presently known methods and apparatuses for hydroentangling filaments are not able to achieve rates of production equal to those of spunbonding filament production.

Various prior art patents disclose techniques for manufacturing nonwoven fabrics by hydroentanglement. U.S. Pat. No. 3,485,706, to Evans, hereby incorporated by reference, discloses methods and apparatus for formation of nonwoven fabrics by hydroentanglement. This patent describes the fiber physics involved in the production of such fabrics, noting that entangled fibers within the fabrics are restrained from movement by interaction with themselves and with other fibers in the fabrics. Such interaction is stated as being caused by the manner in which the fibers are interengaged so as to cause them to interlock with one another. This patent is principally directed toward the entanglement of fibers, but reference is made to entanglement of continuous filament webs. It is believed that the tested samples comprised loose filament webs, and were subjected to laboratory scale treatments that did not appropriately model continuous processing of filamentary webs. It is additionally noted that this patent does not distinguish between fiber entangling physics of the staple or textile length fiber examples set forth therein, and that of the continuous filament examples. It is believed that when subjected to the testing described in the patent, the fabric samples did not provide results that would define differences in their construction. Use of cut hand sheets of spunbond webs is believed to have rendered the filaments thereof in a discontinuous form. Additionally, fiber ends of the cut edges were not constrained, as would be the case during hydroentanglement of an intact continuous filament web. As a consequence, it is believed that the continuous filaments referred to in this patent were actually more in the nature of long staple fibers, and as such, responded to the energy of water jets as staple fibers, that is, recoiling and wrapping around one another. U.S. Pat. No. 3,560,326, to Bunting, Jr., et al., is believed to be similarly limited in its teachings, and thus it is not believed that this patent meaningfully distinguishes between the fiber entangling physics of relatively short fibers (i.e., staple or textile length), and continuous filament examples set forth therein.

U.S. Pat. No. 4,818,594, to Rhodia, contemplates hydroentanglement of fibers having diameters on the order of 0.1 to 6 microns, which by virtue of their micron-sized diameters are clearly formed by melt-blowing, as opposed to spunbonding.

U.S. Pat. No. 5,023,130, to Simpson et al., discloses the use of plexifilamentary fibrous webs which are known in the art as being instantaneously bonded during production. This patent is limited to the use of a very fine mesh forming screen, and the use of water jet pressures that are in excess of 2,000 psi in the initial forming stations.

U.S. Pat. No. 5,369,858, to Gilmore et al., discloses a nonwoven fabric comprising at least one layer of textile fibers or net polymeric filaments, and at least one web of melt-blown microfibers, bonded together by hydroentangling. This patent specifically contemplates that a spunbonded fabric is employed as a substrate for entangling of secondary melt-blown or carded webs, with the patent further contemplating formation of apertures of two differing sizes in the fabric.

As is recognized in the art, the use of particular types of polymeric fibers or filaments can be desirable depending upon the desired physical characteristics of the nonwoven fabric formed from the fibers or filaments. In particular, polyethylene filament webs are desirable for application such as facings, coverstock, and similar applications because of the softness and drapeability the polyethylene provides. A drawback associated with the use of polyethylene filament webs for such applications is the low tensile strength the filaments exhibit. Polypropylene or polyester filament webs are typically strong in comparison to polyethylene, but products formed from polypropylene or polyester filament are relatively stiff in comparison to polyethylene filament products.

It can be difficult to combine polyethylene webs with other stronger webs to produce a product that is both soft and strong. Bonding temperature differences ordinarily make it difficult or impossible to thermally bond a web that might be produced in a continuous process that includes, for example, two filament beams, one producing polyethylene and the other producing polypropylene. A temperature selected to bond the polyethylene is insufficient to bond the polypropylene portion. While it is possible to thermally bond the layers using two thermal bonding steps, thermally bonding the polypropylene as a first step undesirably stiffens the polypropylene. The polyethylene layer added to such a web thus exhibits undesirable stiffness. The resultant laminated product would consist of the polyethylene layer and a relatively stiff reinforcing layer.

As noted above, various methods for making nonwoven fabrics are well-known. In general, these fabrics are made from bonded fibers or filaments, or combinations thereof. In spunbonding, a thermal plastic polymer is melt-extruded into a plurality of continuous filaments and deposited on a conveyor. The filaments are then continuously thermally point-bonded to one another using calender rolls. As also noted, formation of nonwoven fabrics by hydroentanglement entails the use of high intensity, fine jets of water which are impinged on a web, causing the fibers to entangle and form a coherent mechanically bonded structure.

In spunbonding, it is known that the tensile strength of the fabric of a given basis weight can be increased by decreasing the size of the filament. In addition, the uniformity of a fabric of a given basis weight also generally increases with reduced filament size. However, reduced filament causes a reduction of production output and efficiency, whether or not the web is formed as a single layer, or in multiple layers.

In hydroentanglement, the fiber web that is initially deposited consists of individual unbonded fibers, and the web therefore tends to be fragile. For this reason, the pressure of the initial water jets impacting the web must be kept low to avoid excessive fiber displacement, with subsequent jets operating at higher pressures used to more significantly entangle the fibers. This requirement of "pre-entangling" the web with low initial pressure jets decreases the efficiency of the entangling process. One known method proposed for resolving this problem is to support the upper exposed surface of the unbonded web with a perforated screen during entanglement, but disadvantageously involves the use of additional equipment.

In addition, conventional hydroentanglement fabrics as they presently exist are not considered durable, in the sense that they are not launderable. Also, conventional fabrics cannot be subjected to modern jet dyeing processes which involve high flow rates of the treating liquid. These limitations limit the commercial applications of such fabrics and thereby significantly affect their economic value. Proposals have been advanced to treat the finished fabric with a curable binder. This, however, increases the processing effort and cost of the product. Further, the binder may have an adverse effect on the final fabric properties, such as softness and drapeability, as well as the ability to dye the fabric.

Heretofore, durable, launderable nonwoven fabrics have traditionally relied upon relatively high levels of thermal bonding, surface treatments to bond the surface of the fabrics, or stitch bonding techniques to provide a stabilizing network for tying down fiber ends. U.S. Pat. No. 5,192,600 and No. 5,623,888 disclose stitch bonding technology for the production of nonwoven fabrics, with the bulky fabrics described therein stated as being useful in a variety of apparel and industrial end uses. U.S. Pat. No. 5,288,348 and No. 5,470,640 disclose high loft, durable nonwoven fabrics which are produced by serial bonding of layers, followed by an all-over surface bonding with a greater bond area than any of the intermittent bonding steps.

U.S. Pat. No. 5,587,225 describes the use of hydroentangling to bind an interior layer of cellulosic short fibers to outer layers of crimped continuous filaments. While the end product is described as "knit-like" and durable, the product is intended to survive only one laundry cycle, losing up to 5% of the original basis weight during the first washing. While the spunbond outer layers are described as being prebonded, the use of crimped continuous filaments is specifically contemplated, with reliance on the crimped configuration to assist in the retention of short, cellulosic fibers in the entangled matrix. It will be appreciated that the crimping process requires either a mechanical step, or the use of bi-component fibers which develop latent crimp as an aspect of processing, and thus the use of standard spunbond fabrics is not contemplated. Additionally, this patent contemplates the use of a short staple fiber inner layer to increase the opacity and visual uniformity of the final product.

The present invention further contemplates a process for formation of a laminated nonwoven fabric, comprising polymeric filament layers exhibiting differing properties. There is, therefore, an as yet unresolved need in the industry for a process of hydroentangling continuous filaments of relatively large denier, that is, filaments having diameters greater than those generally achieved by melt-blowing formation. Also, there is a heretofore unresolved need in the industry for a hydroentangled nonwoven fabric comprised of continuous filaments of relatively large denier. Further, there is an unresolved need in the industry for an apparatus for producing a nonwoven web comprised of hydroentangled continuous filaments of relatively large denier, and for a method and apparatus for hydroentanglement capable of rates of production substantially equal to spunbonding production rates. A further aspect of the present invention contemplates production of highly durable, dyeable nonwoven fabric made of hydroentangled continuous filaments. The process employs spunbonded webs that are fully stabilized by thermal point bonding with high pressure jets utilized to separate the filaments from the thermal bond points, freeing the filaments for entangling by water jets. Notably, the process contemplates use of multiple prebonded spunbond layers to form a composite web of substantial basis weight, up to 600 g/m$^2$ (grams per square meter).

SUMMARY OF THE INVENTION

The present invention comprises a process for making a nonwoven fabric in which a large number of continuous or essentially endless filaments of about 0.5 to 3 denier are deposited on a three-dimensional support to form an unbonded web, which is then continuously and without interruption subjected to hydroentanglement in stages by water jets to form a fabric. The present invention further entails the production of nonwoven fabrics from a plurality of polymeric webs, wherein the polymeric filaments of the webs exhibit differing physical properties, such as differing bonding temperatures. Additionally, the present invention contemplates the production of hydroentangled nonwoven fabrics from conventional spunbond webs of polymeric filaments, with the use of plural precursor spunbond webs facilitating production of hydroentangled nonwoven fabric having a wide variety of basis weights, up to 600 gm/$^2$.

The hydroentanglement process of the present invention is capable of production rates substantially equal to those of the spunbonding process. The present invention also provides a nonwoven fabric comprised of hydroentangled continuous filaments of 0.5 to 3 denier, wherein the filaments are interengaged by a matrix of packed continuous complex loops or spirals, with the filaments being substantially free of any breaking, wrapping, knotting, or severe bending. The present invention further comprises an apparatus for making a nonwoven fabric, comprising means for depositing continuous filaments of 0.5 to 3 denier on a moving support, and at least one successive group of water jets for hydroentangling the filaments wherein the filaments are interengaged by continuous complex loops or spirals, with the filaments being substantially free of any wrapping, knotting, or severe bending.

The preferred nonwoven fabric of the present invention comprises a web of continuous, substantially endless polymer filaments of 0.5 to 3 denier interengaged by continuous complex loops or spirals, with the filaments being substantially free of any wrapping, knotting, breaking, or severe bending. The terms "knot" and "knotting" as used in the description and claims of this invention are in reference to a condition in which adjacent filaments in a hydroentangled web pass around each other more than about 360° to form mechanical bonds in the fabric.

The fabric of the invention, because of the unique manner in which the filaments are held together, provides excellent tensile strength and high elongation. This is a most surprising result, as it is well-known in the industry that with the exception of elastic nonwoven fabrics, there is an inverse relationship between tensile strength and elongation values. High strength fabrics tend to have lower elongation than fabrics of comparable weight and lower tensile strength.

The surprising high elongation and high tensile strength combination of the present fabric and process results from the novel filament entanglement. As opposed to fiber knotting and extensive wrapping of the prior art, the physical bonding of the continuous filaments of the present invention is instead characterized by complex meshed coils, spirals, and loops having a high frequency of contact points. This novel filament mechanical bonding provides high elongation values in excess of 90% and more typically in excess of 100% in combination with high tensile strength as the meshed coils and loops of the invention disengage and filaments straighten and elongate under a load. Knotted fibers of the prior art, on the other hand, tend to suffer fiber breakage under load, resulting in more limited elongation and tensile strengths.

The effect of the novel packed loops of the fabric and process of the invention also results in a distinctive and commercially advantageous uniform fabric appearance. The individual fiber wrapping and knotting of prior art hydroentangled fabrics leads to visible streaks and thin spots. The complex packing of the loops and coils of the present invention, on the other hand, provides better randomization of the filaments, resulting in a more consistent fabric and better aesthetics. Because the novel packing of the filaments of the invention is substantially free of loose filament ends, the fabric of the invention also advantageously has high abrasion resistance and a low fuzz surface.

The preferred process of the present invention includes melt-extruding at least one layer of continuous filaments of 0.5 to 3 denier onto a moving support to form a precursor web, continuously and without interruption pre-entangling the web with at least one pre-entanglement water jet station having a plurality of water jets, and finally entangling the filament web on a three-dimensional image transfer device with at least one entanglement water jet station to form a coherent web. The pre-entangling water jets are preferably operated at a hydraulic pressure of between 100-5,000 psi, while the entangling water jets are operated at pressures of between 1,000-6,000 psi. Hydraulic pressures used will depend on the basis weight of the fabric being produced, as well as on qualities desired in the fabric, as will be discussed in detail below. Use of plural precursor webs which are laminated by hydroentanglement on a three-dimensional image transfer device is also contemplated.

Contrary to conventional wisdom, it has been found that an unbonded web of continuous and essentially endless filaments of relatively large denier may be produced on a modern high speed spunbond line. Such a web may be produced as the continuous filaments have sufficient curvature and mobility, while being somewhat constrained along their length, to allow entanglement in the unique manner of the invention. The dynamics of the interengaged packed loops of the fabric of the invention are thus entirely different from the hydroentanglement of staple fibers of the same denier.

The preferred apparatus of the present invention comprises a means for continuously depositing substantially endless filaments of 0.5 to 3 denier on a moving support to form a web, and at least one water jet station for hydroentangling the filament web. Preferably, at least one preliminary water jet pre-entangling station is also provided. The moving support preferably comprises a porous single or dual wire, or a forming drum. An additional water jet station and an additional forming drum may further be provided in the preferred embodiment of the apparatus for impinging a pattern on the fabric. Also, a preferred apparatus embodiment may further comprise means for introducing a second component web, such as staple fibers, pulp, or melt-blown webs, to the web of the invention, as a subsequent step.

A further aspect of the present invention contemplates a process for making a laminated nonwoven fabric, wherein each of the lamination comprises substantially continuous polymeric thermoplastic filaments. Plural precursor webs are provided, with hydroentangling of the precursor webs on a three-dimensional image transfer device acting to interengage the filaments of adjacent ones of the webs to form respective plural laminations of the nonwoven fabric. This aspect of the invention can be advantageously employed for formation of nonwoven fabrics wherein the thermoplastic filaments of each of the webs exhibit differing properties.

In particular, the present process contemplates that the thermoplastic filaments of each web exhibit a bonding temperature which differs significantly from the bonding temperature of the filaments of an adjacent one of the webs. This aspect of the invention more particularly contemplates that one of the precursor webs comprises polyethylene filaments having a denier of about 2 to 5, with this precursor web comprising from about 40% to 90% of the weight of the resultant nonwoven fabric. The use of polyethylene filaments desirably provides the resultant nonwoven fabric with softness and drapeability. An adjacent one of the precursor webs comprises thermoplastic filaments selected from the group consisting of polypropylene and polyester, wherein the filaments have a denier of about 0.5 to 3. The one or more adjacent webs can be selected for their strength characteristics, with it further contemplated that the nonwoven fabric can be provided with two exterior polyethylene filament laminations, and an intermediate lamination formed from differing polymeric filaments, such as polypropylene or polyester.

In accordance with a further aspect of the present invention, conventional spunbond webs, that is, thermally point bonded webs of thermoplastic filaments, serve as starting materials or precursor webs for the process and product of the invention. The substrate, spunbond webs are entirely stable and can, for example, be handled without losing their integrity and cohesiveness in operations such as winding, unwinding, slitting, and conveying under tension. At least two spunbond webs are provided in a layered fashion, preferably in a continuous or semi-continuous process, for example, from a series of supply rolls to form a composite web of substantial basis weight, up to 600 g/m$^2$. The fabric of the invention is preferably produced from a polyester (PET, polyethylene terephthalate) spunbond substrate. As such, the fabrics are highly durable, and can be dyed in standard textile dyeing and finishing processes.

At least one side of the layered web structure is subjected to fine water jets operated at high pressure. Notably, the force of the water jets causes the previously formed thermal point bonds within the substrate or precursor spunbond webs to be substantially entirely broken such that the web filaments become loose filaments, and are simultaneously entangled by the water jets with loosened filaments from other web layers. It is notable that the bond points themselves are split, rather than the filaments breaking loose from the bond points at the entry site. In this manner, substantially continuous filaments are maintained and free fiber ends are not created by the process. The creation of substantially continuous filaments from the spunbonded webs is desirably effected, rather than breakage of the thermal bonds in the spunbond webs which would form relatively short, fiber-like segments of the filaments.

The entanglement of the continuous filaments on a three-dimensional image transfer device results in a cohesive, durable fabric in which the filaments form a complex arrangement of packed loops and spirals that is substantially free of filament breakage. Also, the structure is substantially free of any knotting or wrapping of fibers at sharp angles, normally found in conventional hydroentangled fabrics made from staple length fibers or pulp.

The prebonded or partially entangled webs can be treated on a apertured forming surface or roll having a three-dimensional surface pattern in order to rearrange the filaments and impart a pattern to at least one side of the fabric. Preferably, both sides of the layered structure are subjected to water jets.

The resulting fabrics of the present invention are very durable and strong in comparison with conventional hydroentangled fabrics. If the fabrics are made from spunbond polyester substrate webs, for example, they can be subjected to the rigors of a jet dyeing process. The fabrics can thereby advantageously replace many standard woven textiles at a significantly lower cost. Depending on the desired end use, very high basis weight fabrics can be produced having a number of layers and basis weights up to 600 g/m$^2$.

In a further embodiment of the invention, the initial spunbond webs can be produced in a highly efficient, high speed operation, as the raw polymer is converted into a stable point bonded web in a continuous operation. Advantageously, this process of the invention does not require low pressure pre-entanglement jets, thereby improving the efficiency of the process.

Due to the high durability and strength of the fabric, many finishing processes are facilitated. The fabric can be subjected to multiple uses and is launderable. Despite being durable, the fabrics of the present invention also exhibit desirable aesthetic qualities and in this respect are comparable to conventional and more expensive nonwoven fabrics. Also, layering of the stable substrate webs allows use of smaller sized filaments, with the result that the final fabric has a higher strength and better uniformity than a fabric of the same basis weight comprised of larger filaments.

The above brief description sets forth rather broadly the more important features of the present invention so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

BRIEF DESCRIPTION OF THE DRAWINGS

FIG. 8 is a 10× photomicrograph of a prior art hydroentangled staple fiber web;

Chart 1 shows Grab Tensile strength for various webs;

Chart 2 shows Tensile pounds/% Elongation at Peak Tensile;

Chart 3 shows Grab Tensile pounds for 6 inch×4 inch samples for various webs; and Table 1 compares measured values between various nonwoven fabrics of the invention and various prior art nonwoven fabrics.

DETAILED DESCRIPTION

Figure 1:
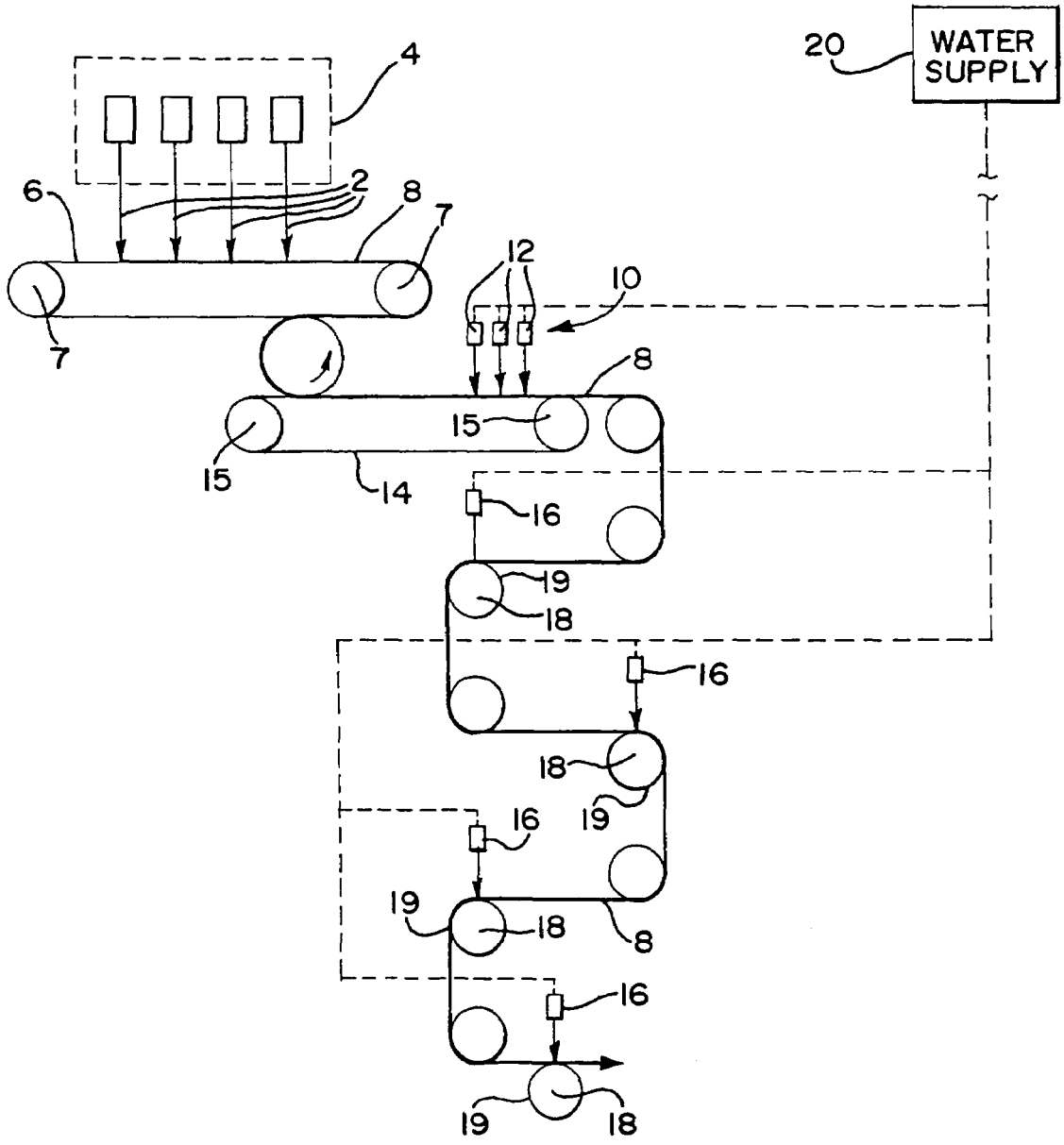
FIG. 1 is a schematic view of one embodiment of the invention.

Turning now to the drawings, FIG. 1 illustrates a first embodiment of the process and apparatus of the invention. Continuous filaments 2 are melt-extruded, drawn, and then deposited by beam 4 on moving porous support wire 6 winding on rollers 7 to form an unbonded filament web 8. After drawing, filaments 2 have a denier of between about 0.5 to 3, with a most preferred denier of 1 to 2.5, and are preferably comprises of a melt-extruded thermoplastic polymer, such as polyester, polyolefin (such as polypropylene), or polyamide. As filaments 2 are continuously extruded, they are substantially endless. Deposited, unbonded filament web 8 is relatively fragile, thin, and easily disturbed. Web 8 may be comprised of more than one layer of filaments 2. The dominant orientation of filaments 2 is in the machine-direction, with some degree of overlap in the cross-direction. If desired, a variety of techniques may be employed to encourage further separation of individual filaments 2 and greater randomness in the cross-direction. These techniques may include, but are not limited to, impinging filaments 2 with air currents, electrostatic charging, or contact with solid objects. Also, as is well-known in the art, vacuum may be drawn through support wire 6 in the area of depositing filaments 2.

Web 8 is continuously and substantially without interruption advanced to pre-entangling station 10 for pre-entanglement with a plurality of individual pre-entangling jets 12 that direct water streams of a hydraulic pressure onto web 8. Preferably, pre-entangling station 10 comprises from one to four sets of pre-entangling jets 12, with one to three most preferred. Preferred pre-entangling jets 12 operate at hydraulic pressures between 100 to 5,000 psi, and have orifice diameters ranging from 0.004 to 0.008 inches, with 0.005 to 0.006 inches most preferred. Jets 12 further have a hole orifice density of from 10 to 50 holes per inch in the cross-direction, with at least 20 per inch most preferred. The number of individual jet streams per jet 12 will vary with the width of web 8; jet 12 will extend substantially across the width of web 8, with individual jet streams at a density of 10 to 50 per inch. The pressures of individual pre-entangling jets 12 may vary as desired depending on fabric basis weight and desired pattern. For pre-entangling a web 8 with a basis weight of no greater than 50 gm/m$^2$, for instance, a preferred pre-entangling station 10 will comprise three individual sets of jets 12 operating sequentially at pressures of 100, 300, and 800 psi. A preferred pre-entangling station 10 for a web 8 of a basis weight greater than 50 gm/m$^2$ will comprise three individual sets of water jets 12 operating respectively at pressures of 100, 500, and 1,200 psi.

During pre-entanglement, web 8 is supported on moving support 14, which may comprise a forming drum, or as illustrated, a single or dual wire mesh rotating about rollers 15. Because filaments 2 are substantially endless and of considerable denier, support 14 need not be of fine mesh as may be required for shorter or finer fibers of the prior art. For high pre-entanglement hydraulic pressures associated with heavier basis weight fabrics, supporting web 8 on a rotating forming drum is preferred. The purpose of pre-entanglement is to create some cohesiveness in web 8 so that web 8 can be transferred and will not be destroyed by the energy of subsequent high pressure hydroentanglement. After pre-entangling, web 8 is observed to have minimal entanglement and low strength values.

After pre-entangling, the continuously moving web 8 is next subjected to high pressure hydroentangling. High pressure hydroentangling may be achieved at a hydro-entanglement station that comprises a plurality of sets of water jets 16. High pressure jets 16 for entangling preferably are directed at the "backside" of web 8 opposite the "frontside" onto which pre-entangling jets were directed. Or, as shown in FIG. 1, high pressure jets 16 may alternately be directed at one and then the opposite side of web 8. High pressure water jets 16 operate at hydraulic pressures of between 1,000 to 6,000 psi. For webs of basis weight at or below 50 gm/m$^2$, one to four sequentially high pressure jets 16 are preferred, operating a pressures between 1,000 to 2,000 psi, with 1,600 psi most preferred. For webs of basis weight greater than 50/gm/m$^2$, one to four sequential high pressure jets 16 are preferred operating a pressures between 3,000 and 6,000 psi. Preferred high pressure jets 16 have an orifice diameter of from 0.005 to 0.006 inches, and have a hole orifice density of from 10 to 50 holes per inch in the cross-direction, with at least 20 per inch most preferred. The number of individual jet streams will vary with the width of web 8; jets impinge web 8 across substantially its entire width with individual streams at a density of 10 to 50 holes per inch.

When high pressure hydroentanglement is carried out at hydrostatic pressures greater than 1,600 psi, web 8 is preferably supported on rotating forming drum 18. Drums 18 preferably have a patterned three-dimensional surface 19 to control the X-Y spatial arrangement in the plane of filaments 2, as well as in the Z-direction (web thickness).

Both pre-entanglement jets 12 and entanglement jets 16 may be supplied by a common remote water supply 20, as illustrated in FIG. 1. Water temperature may be ambient. Spacing between both pre-entanglement jets 12 and entanglement jets 16 and web 8 is preferably between 1 to 3 inches. It is also noted that the distance between individual jet stations, and hence the time elapsed between impinging web 8 with jet streams, is not critical. In fact, web 8 may be stored after pre-entangling with pre-entanglement jets 12 for later entanglement, although the preferred process is continuous.

A major limitation in prior art practices is the ability to operate a hydroentanglement line for a web of fibers at a high rate of speed such as the line speed of a modern spunbond line. The use of high water pressures and hence high energy levels would be expected to cause the fiber to be driven excessively into screens of standard mesh size, or to cause undue displacement of the fibers. It has been found, in accordance with the present invention, that much higher energies can be used in the entanglement station while using standard mesh size screens, allowing for an increase in line speeds comparable to the normal line speed of the spunbond line. Thus, there is no need for an accumulator or other means to act as a "buffer" between filament production and final entangled web output or for support screens of fine mesh as may be required by processes and apparatuses of the prior art. As an example of the above, 3 denier polypropylene filament webs are subjected to an energy of 1.5 to 2 horsepower hours per pound (HP-hr/lb) in the high pressure entanglement stations. Other examples are 0.4 to 0.75 HP-hr/lb for 1.7 denier polypropylene and 0.3 to 0.5 HP-hr/lb for 2 denier polyester filaments. If a final patterning operation is employed, the energy levels are approximately double those described above.

Figure 2:
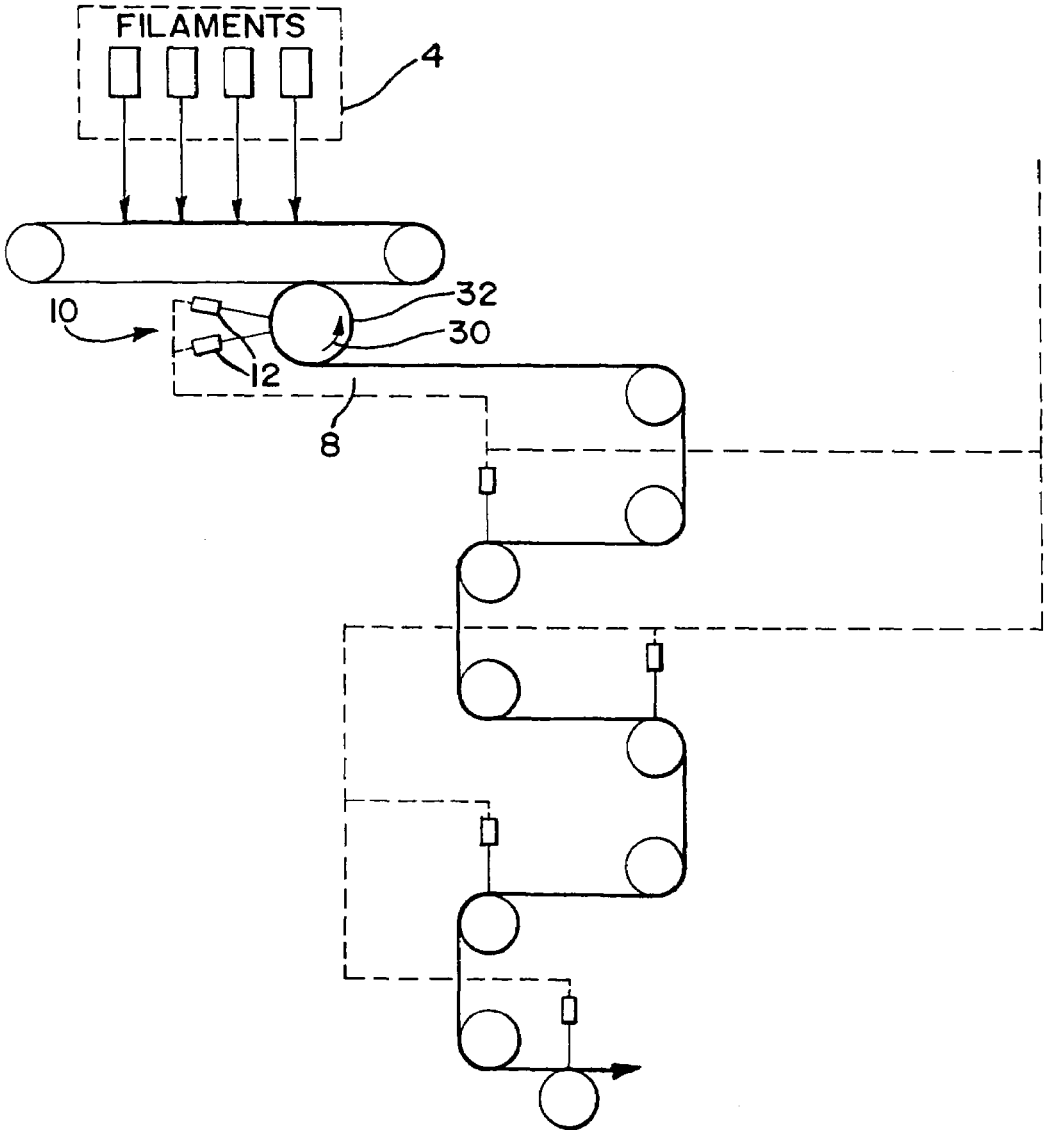
FIG. 2 is a schematic view of another embodiment of the invention.
Figure 3B:
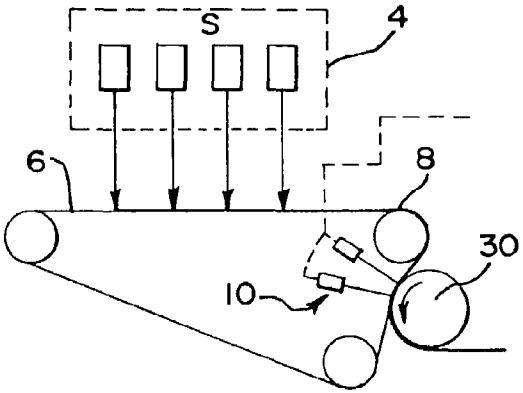
FIG. 3B is a schematic view of another embodiment of the invention.
Figure 3D:
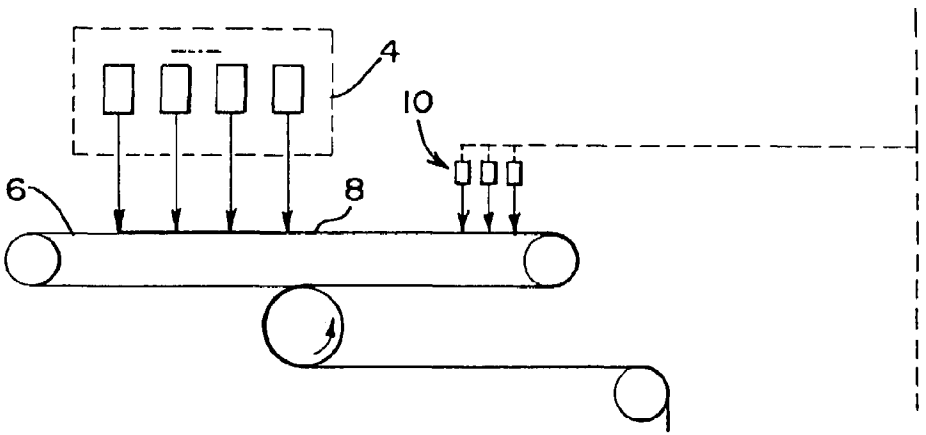
FIG. 3D is a schematic view of another embodiment of the invention.
Figure 3A:
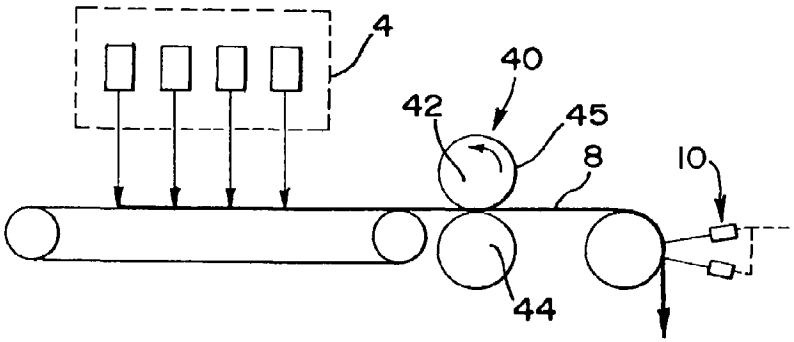
FIG. 3A is a schematic view of another embodiment of the invention.
Figure 3C:
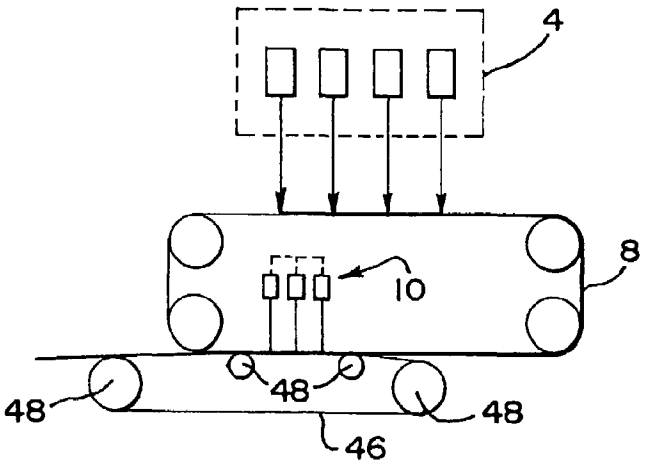
FIG. 3C is a schematic view of another embodiment of the invention.

FIG. 2 shows another embodiment of the apparatus and process of the invention. In this embodiment, pre-entangling station 10 is comprised of two individual sets of pre-entangling water jets 12, and web 8 is supported through pre-entangling on porous forming drum 30. Use of forming drum 30 is preferred for webs of a basis weight over 50 gm/m$^2$, when higher pre-entangling hydraulic pressures are used. As discussed, forming drum 30 preferably has a three-dimensional forming surface 32.

A preferred forming drum and a method for using are described in U.S. Pat. No. 5,244,711 and No. 5,098,764, incorporated herein by reference. In these references, an apertured drum is provided with a three-dimensional image transfer device having a surface in the form of pyramids, with the drainage apertures being located at the base of the pyramids. Many other configurations for the surface of the drum are also feasible. Although these references disclose the hydroentanglement of staple fibers to produce knotted, apertured fabrics, it has been found that these drums may likewise be used with the continuous pre-entangled filament webs of the present invention.

In the following examples, reference to a "20×20" image refers to a rectilinear forming pattern in the form of a pyramidal array, having 20 lines per inch by 20 lines per inch, configured in accordance with the pyramidal array illustrated in FIG. 13 of U.S. Pat. No. 5,098,764, hereby incorporated by reference. The image differed in that mid-pyramid drain holes are omitted. Drain holes are present at each corner of the pyramids (i.e., four holes surround each pyramid). The pyramid height is 0.025 inches, and drain holes have a diameter of 0.02 inches. Drainage area is 12.5% of the surface area.

Reference to "33×28" forming surface refers to a three-dimensional image transfer device configured in accordance with the pyramidal array illustrated in FIG. 13 of U.S. Pat. No. 5,098,764, having 33 lines per inch (MD) by 28 lines per inch (CD), with drain holes present at each corner of the pyramid.

Reference to a "tricot" forming surface refers to a three-dimensional image transfer device configured in accordance with the teachings of U.S. Pat. No. 5,585,017, herein incorporated by reference.

FIG. 3 shows additional embodiments of the pre-entanglement portion of the process and apparatus of the present invention. In FIG. 3A, calender 40 provides light thermal bonding to web 8 prior to pre-entanglement at pre-entangling station 10. Preferred calender 40 comprises heated rollers 42 and 44, with surface 45 of roller 42 having a pattern for embossing on web 8. FIG. 3B shows pre-entanglement station 10 entangling web 8 with web 8 supported by forming wire 6. Note that forming drum 30 is used to restrain forming wire 6. FIG. 3C shows web 8 being supported between forming wire 6 and a second wire 46 rotating about rollers 48. Also, as shown in FIG. 3D, pre-entangling station 10 may be positioned directly in line with filament attenuator 4 with web 8 supported by forming wire 6.

Figure 4:
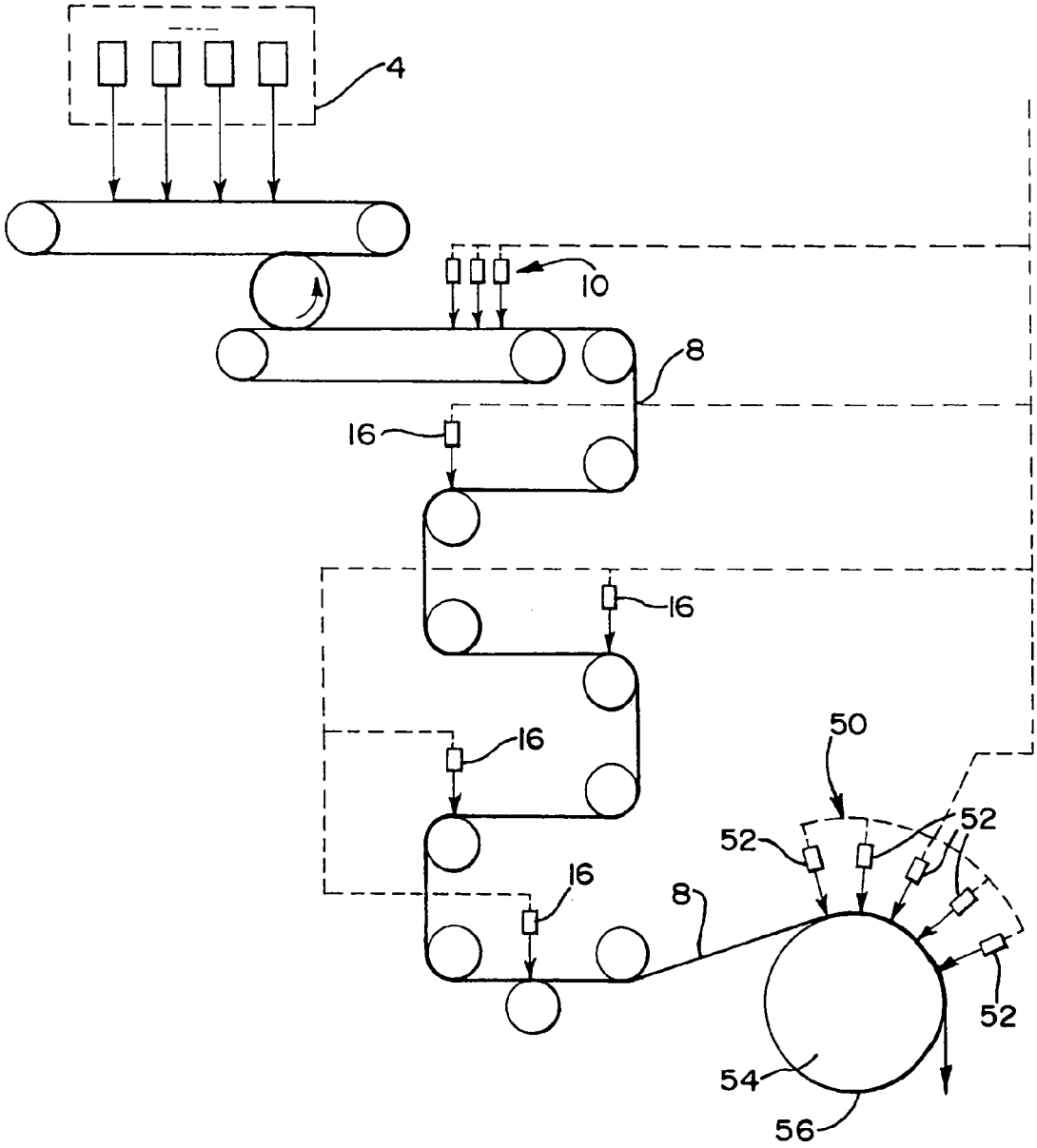
FIG. 4 is a schematic view of another embodiment of the invention.

FIG. 4 shows another embodiment of the apparatus and process of the invention, further comprising pattern imparting station 50. Pattern imparting station 50 comprises rotating pattern drum 54, with three-dimensional surface 56, and pattern water jets 52. A plurality of jets 52 are provided, each with a plurality of individual jet streams, operating at pressures that may be varied depending on the basis weight of the web and the detail of the pattern to be embossed. Generally jets 52 operate at 2,000 to 3,000 psi for webs of a basis weight less than 50 gm/m$^2$, and at 3,000 to 6,000 psi for heavier webs.

Figure 5A:
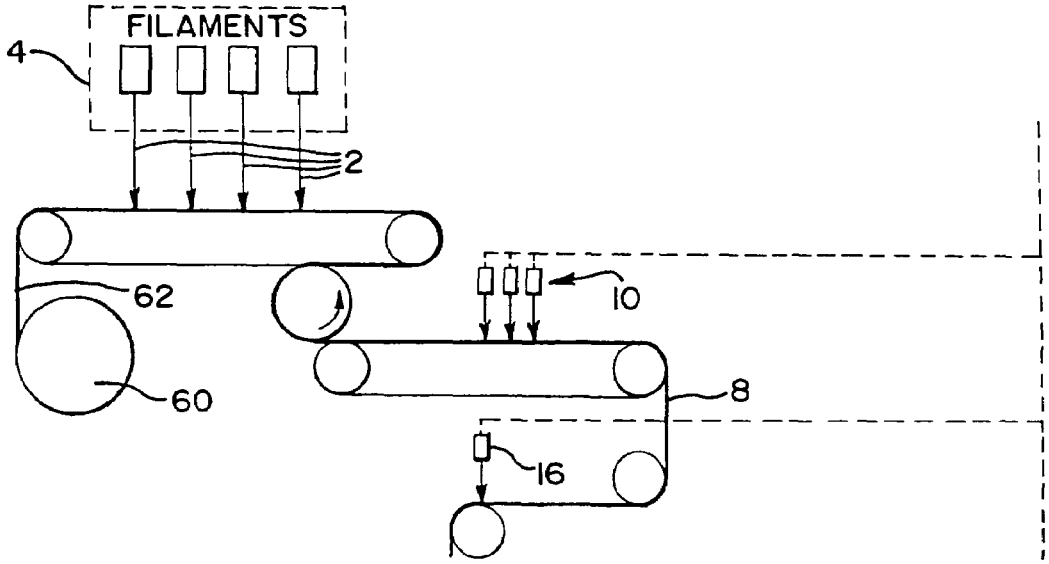
FIG. 5A is a schematic view of another embodiment of the invention.
Figure 5B:
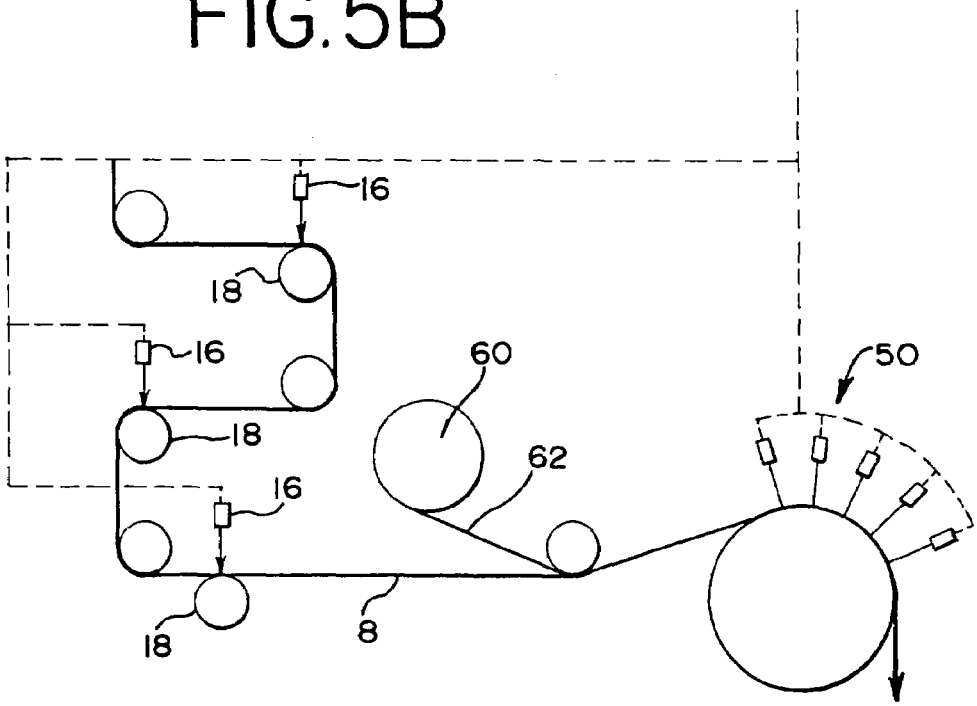
FIG. 5B is a schematic view of another embodiment of the invention.

FIGS. 5A and 5B show additional embodiments of the apparatus and process of the invention where a secondary web is introduced. The secondary web may comprise carded staple fibers, melt-blown fibers, synthetic or organic pulps, or the like. FIG. 5A shows roller 60 dispensing secondary web 62 upstream of attenuator 4, so that filaments 2 will be deposited onto secondary web 62. Secondary web 62 is thus entangled with filaments 2 through downstream pre-entangling station 10 and downstream entangling jets 16. FIG. 5B shows secondary web 62 being dispensed from unroller 66 downstream of entangling jets 16, and upstream of patterning station 50. Secondary web 62 and web 8 are entangled in this embodiment at patterning station 50.

The preferred nonwoven fabric of the present invention comprises a web of continuous, substantially endless polymer filaments of 0.5 to 3 denier, with 1.2 to 2.5 denier most preferred, interengaged by continuous complex loops or spirals, with the filaments being substantially free of any wrapping, knotting, breaking, or severe bending. As discussed infra the terms "knot" and "knotting" as used herein are in reference to a condition in which adjacent fibers or filaments pass around each other more than 360° to form mechanical bonds in the fabric. Knotting occurs to a substantial degree in conventional hydroentangled fabrics made from staple fibers, or those prepared with a scrim or net and staple fibers.

The hydroentangled continuous webs of substantially endless filaments that comprise the fabric of the present invention, on the other hand, are substantially free from such knotting. The mechanical bonding of the fabric of the present invention is characterized by enmeshed coils, spirals, and loops having a high frequency of contact points to provide high tensile strength, while the coils and loops are capable of release at higher load. This results in high cross-direction elongation values for the fabric of the invention that are preferably in excess of 90%, and more preferably in excess of 100%. A preferred machine direction elongation value is at least 75%. The combination of high elongation and tensile strength is a novel and surprising result as conventional hydroentangled fabrics because of fiber knotting have an inverse proportional relationship between tensile strength and elongation: high strength fabrics tend to have lower elongation than fabrics of comparable weight with lower tensile strength. The preferred fabric of the present invention, on the other hand, enjoys a proportional relationship between elongation and tensile strength: as fabric elongation increases, in either the CD (cross-direction) or MD (machine-direction), tensile strength (in the same direction) likewise increases.

The nonwoven fabric of the present invention is preferably comprised of a polyamide, polyester, or polyolefin such as polypropylene. In addition, the fabric of the invention may comprise secondary component webs including, but not limited to, webs comprising staple polymer fibers, wood or synthetic pulp and melt-blown fibers. The secondary web components may comprise between 5% and 95% by weight of the fabric of the invention. Also, the fabric of the invention may comprise a surface treatment such as an antistat, anti-microbial, binder, or flame retardant. The fabric of the invention preferably has a basis weight of between about 20 and 450 $gm/m^2$.

Figure 6:
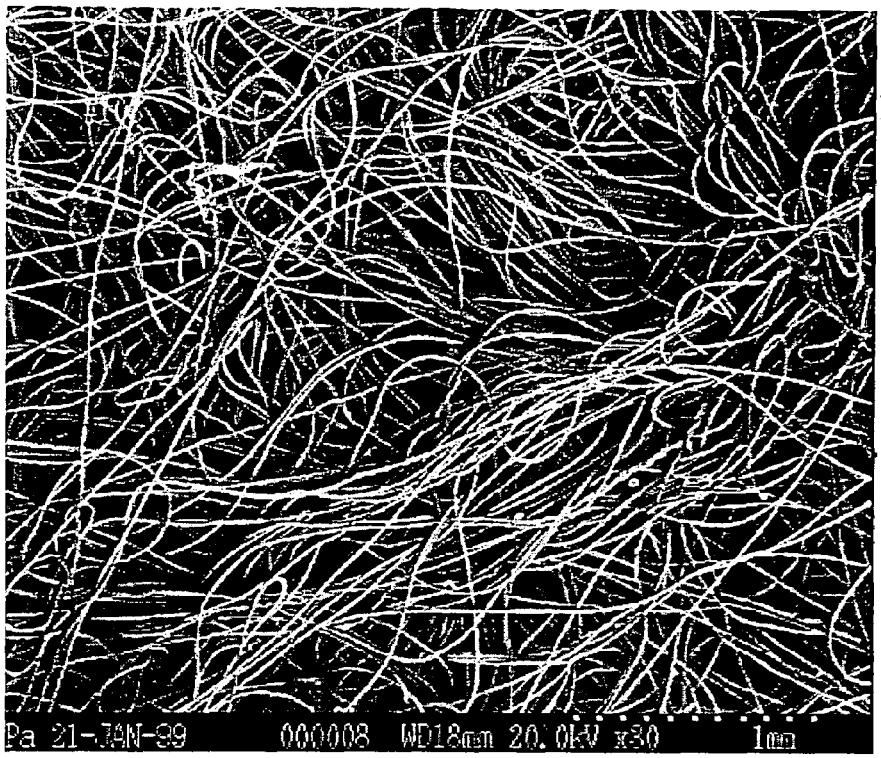
FIG. 6 is a 30× photomicrograph of an embodiment of the fabric of the invention.
Figure 7:
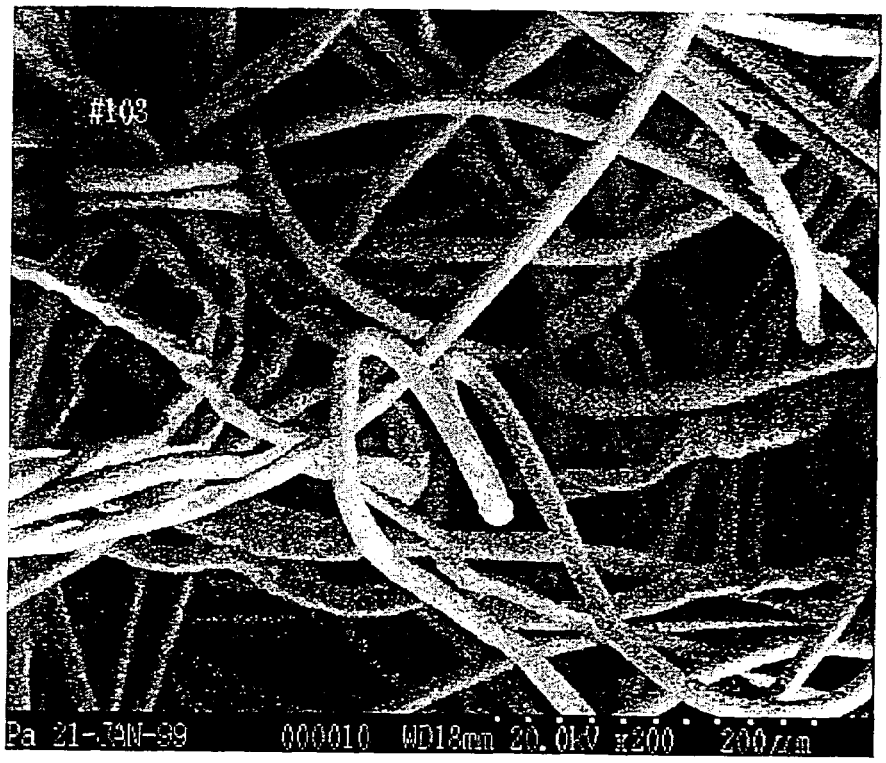
FIG. 7 is a 200× photomicrograph of an embodiment of the fabric of the invention.
Figure 7A:
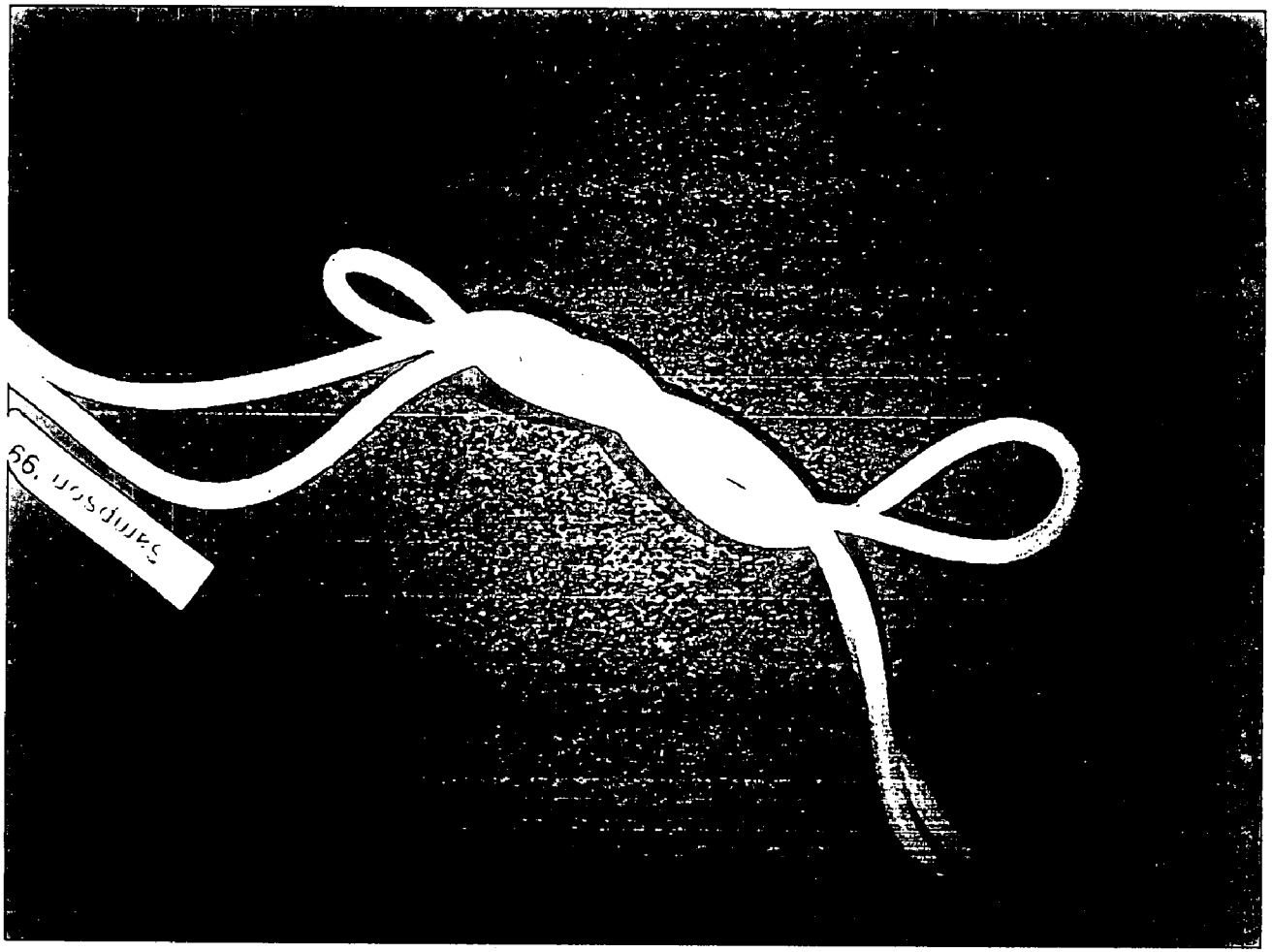
FIGS. 7A to 7C are views showing modeling of interloop entangling in accordance with the present invention.
Figure 7B:
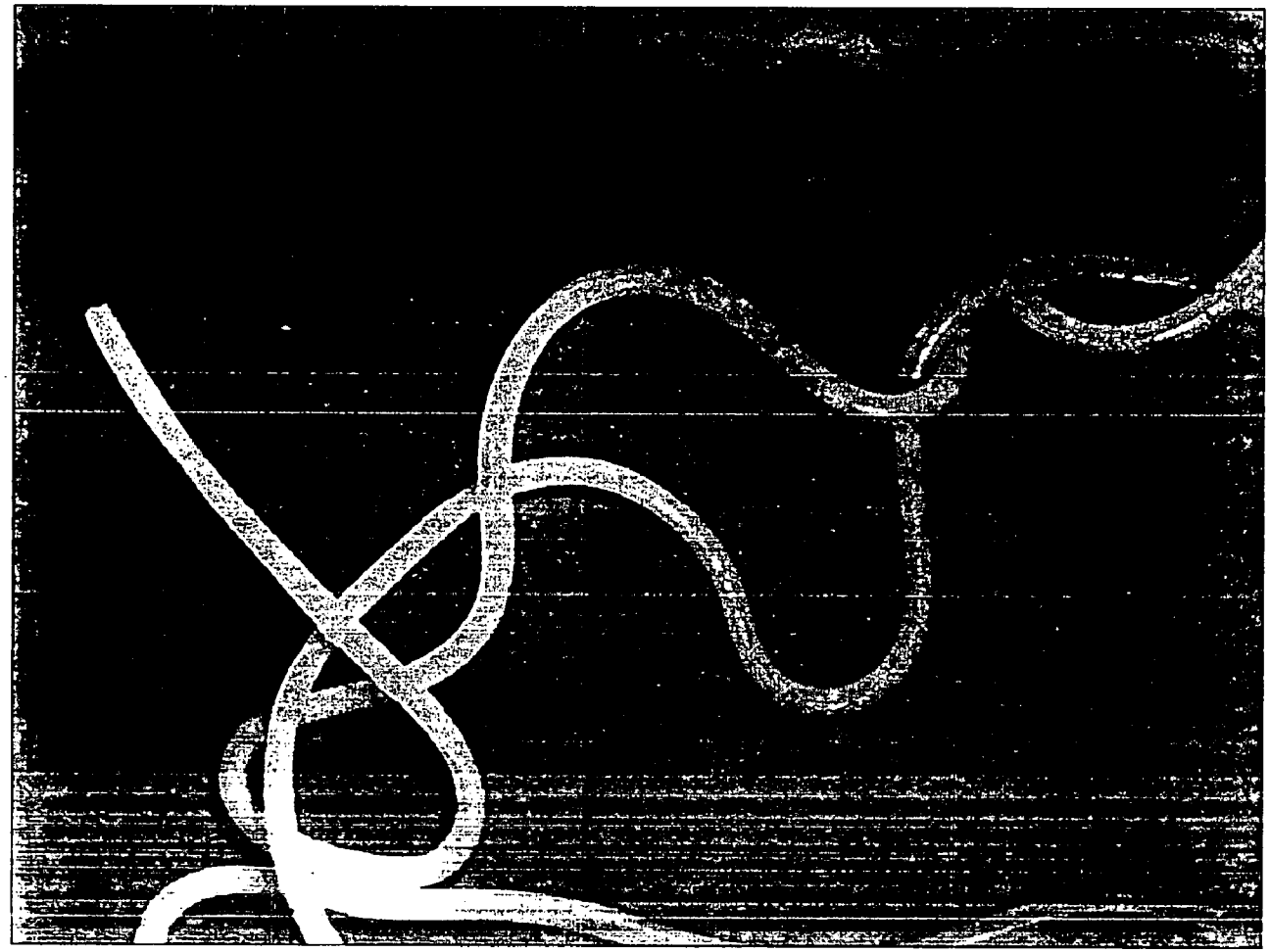
Figure 7C:
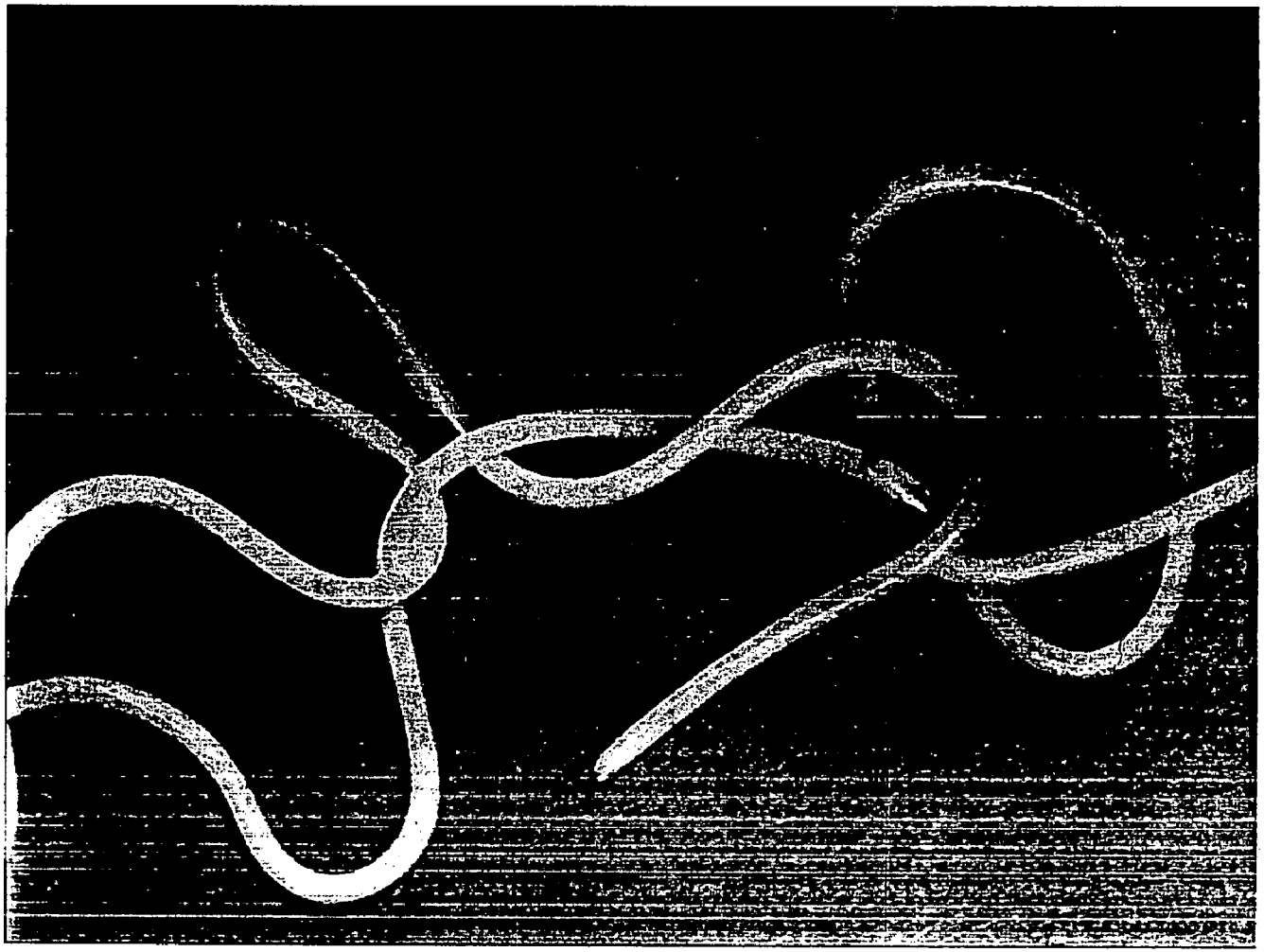

FIG. 6 is a photomicrograph of an embodiment of the fabric of the invention at 30× magnification. This fabric sample is comprised of 1.7 denier polypropylene continuous fibers with a fabric basis weight of 68 $gm/m^2$. As evident in the photomicrograph, the fabric of the invention has filament mechanical bonding characterized by winding interengaged spiral coils and loops, and is substantially free of filament knotting or breaking. FIG. 7 is a photomicrograph of the same sample at 200× magnification. The three-dimensional characteristics of the interengaged loops and spirals is more clearly shown by the increased magnification of FIG. 7. FIGS. 7A, 7B, and 7C are views of modeling of filaments showing interloop entangling, representative of the type of filament entangling of fabrics formed in accordance with the present invention.

Figure 8A:
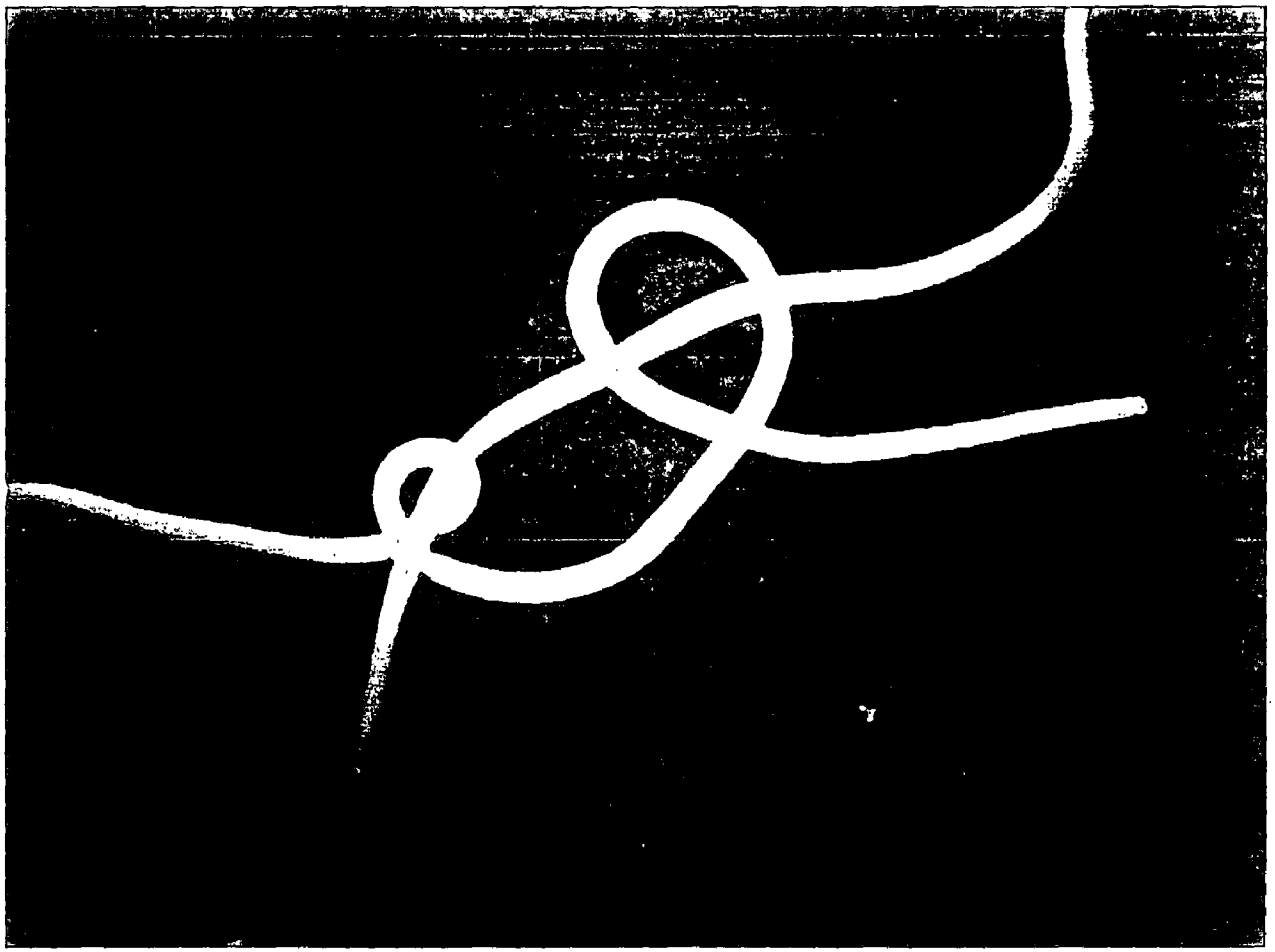
FIGS. 8A and 8B are views showing modeling free fiber end wrapping and entangling.
Figure 8B:
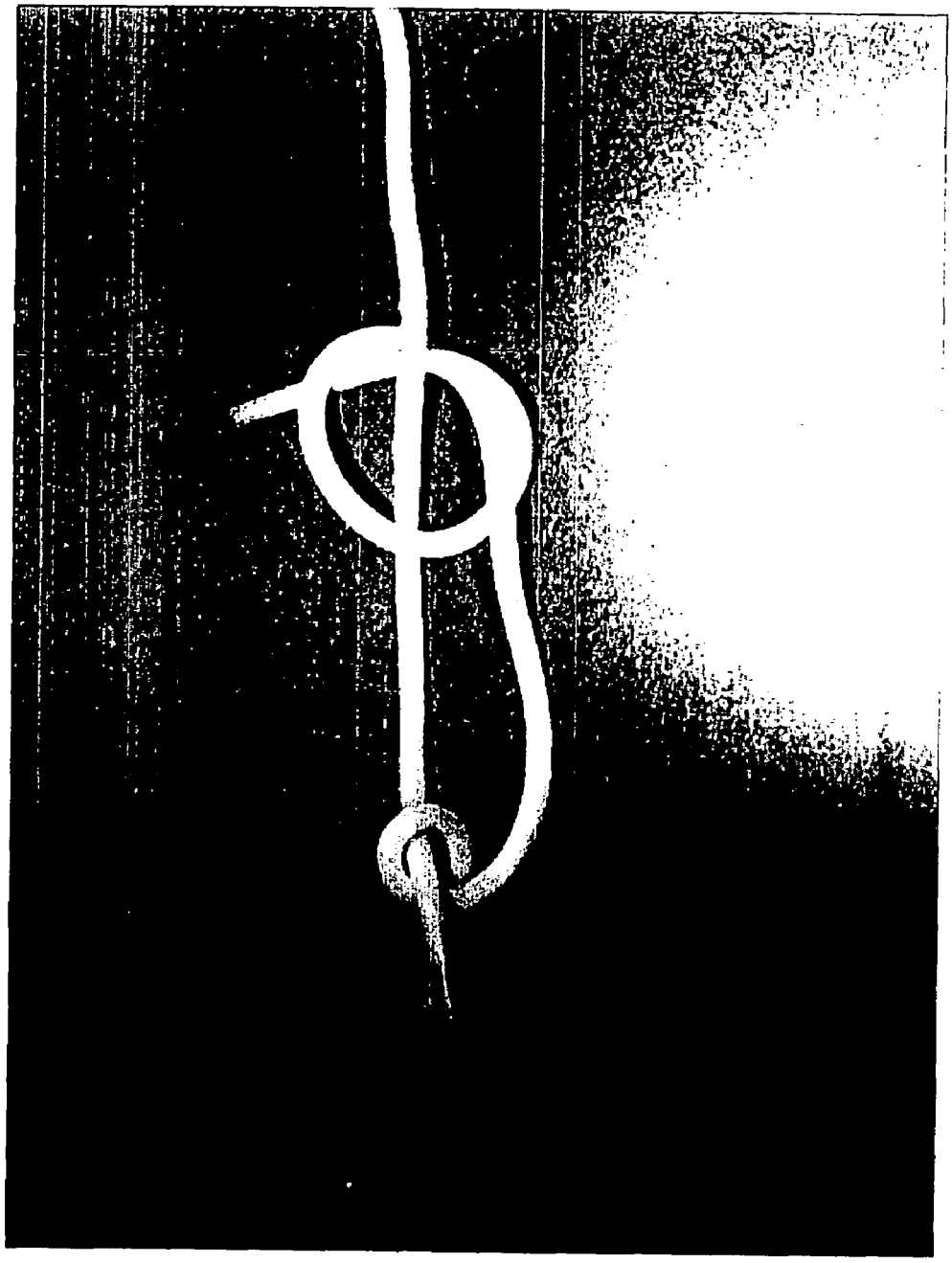

FIGS. 6 and 7 are contrasted with FIG. 8, which is a photomicrograph of a hydroentangled web of the prior art comprised of staple PET/Rayon fibers. As can be seen in FIG. 8, the hydroentangled web of the prior art shows numerous free fiber ends, as well as a high occurrence of fibers wrapped about one another and otherwise knotted. FIGS. 8A and 8B are views of modeling of wrapping, entangling, and knotting of free fiber ends, as would be characteristic of prior art fabrics formed from staple fibers and the like.

The appearance and properties of the fabric are believed to be unique as the continuous filaments are substantially immobile in the fabric and do not substantially individually reduce in length along the filament axis or in the general cross- or machine-directional width of the fibrous web during the hydroentanglement process. In contrast, during the hydroentanglement of staple fibers, the loose ends of the fibers allow them to freely alter their spatial arrangement in the web, in the process of wrapping around themselves or neighboring fibers, forming knots from the interlaced fibers. This wrapping and knotting can lead to observable streaks and thin spots. The complex packing of the loops and coils of the fabric of the present invention, on the other hand, provides better randomization of the filaments, resulting in a more consistent fabric and better aesthetics. The fabric of the invention this has a distinctive and commercially advantageous uniform fabric appearance.

The nonwoven fabric of the present invention may further comprise a secondary chemical treatment to modify the surface of the final fabric. Such treatments may comprise spray, dip, or roll applications of wetting agents, surfactants, fluorocarbons, antistats, antimicrobials, flame retardants, or binders. Further, the fabric of the present invention may comprise a secondary web entangled with the web of the invention, such a secondary web may comprise prefabrics, pulps, staple fibers or the like, and may comprise from 5 to 95% on a weight basis of the composite fabric.

After the final entanglement steps, the fabric is dried using methods well known to those skilled in the art, including passage over a heated dryer. The fabric may then be wound into a roll. In order to achieve the superior physical properties of the product of the present invention, no additional bonding, such as thermal or chemical bonding, is required.

The fabrics of the present invention have many applications. They may, for example, be used in the same applications as conventional fabrics. In particular, the nonwoven fabric of the present invention may find particular utility in applications including absorbent articles, upholstery, and durable, industrial, medical, protective, agricultural, or recreational apparel or fabrics.

A first sample fabric of the invention was prepared using the process and apparatus generally described infra and shown in FIG. 1. The sample was prepared using 2.2 denier polypropylene filament, with a web basis weight of 32 $gm/m^2$. The sample was prepared using three pre-entanglement jets 12 of FIG. 1 operating sequentially at 100, 300, and 800 psi; and with three entanglement jets 16 operating sequentially at 1,200, 1,600, and 1,600 psi. To demonstrate the effect of each stage of entanglement, grab tensile strength was measured after initial filament deposit, pre-entanglement, and entanglement, with the results shown in Chart 1. The profound effect of the high pressure entanglement jets is demonstrated in the results.

A second sample fabric of the invention was likewise prepared with 2.2 denier polypropylene filament of a basis weight of 132 $gm/m^2$. The fabric was prepared using the apparatus and process as described infra and shown in FIG. 1, with the pre-entanglement jets operating sequentially at 25, 500, and 1,200 psi. Two entanglement jets were used operating at 4,000 psi. The results of grab tensile and elongation testing of these samples are presented in Chart 2. It is noted that the sample prepared using two entanglement jets showed better properties.

A third sample fabric of the invention with a 68 $gm/m^2$ basis weight was made using the apparatus as generally shown in FIG. 1 using polypropylene. For comparison, a "control" fabric of the same basis weight and denier was prepared using the apparatus as shown in FIG. 1, but with short staple fibers replacing the continuous filaments of the present invention. Grab tensile strengths of the two fabrics were tested, with results shown in Chart 3. The superiority of the fabric of the invention over the more traditional hydroentangled staple fiber fabric is clearly shown.

In order to further define the fabric of the invention and its various advantages, a first series of fabrics of the invention were prepared using the process and apparatus as described herein. It is noted that the fabrics of the present invention may be referred to as "Spinlace™", which is a trademark of the Polymer Group, Inc. A second series of fabrics was prepared for comparison, consisting of hydroentangled carded staple fibers entangled by a traditional hydroentanglement process. The fabrics of the first and second series were both of basis weights between about 34 and 100 gm/m$^2$, and both were made using polypropylene fibers and filaments of similar denier. The fabrics of the first and second series were then tested according to standard methods as known by those skilled in the art for basis weight, density, abrasion resistance (Taber-abrasion resistance is measured by pressing the fabric down upon a rotating abrasion disc at a standard load), grab tensile, strip tensile, and trapezoid tear. The test methods used and characteristics tested for are descried generally in U.S. Pat. No. 3,485,706 to Evans, herein incorporated by reference.

Three other qualities were also tested, including entanglement completeness (a measure of the proportion of the fibers that carry the stress when tensile forces are applied, see below), entanglement frequency (a measure of the surface stability, entanglement frequency per inch of fiber, see below), and fiber interlock (a measure of how the fibers resist moving when subjected to tensile forces, see below). Results of testing are presented in Table 1. Note that "Apex" is a trademark of the Polymer Group, Inc., and as used in the Table refers to a pattern drum having a three-dimensional surface (i.e., a three-dimensional image transfer device). Also, the "flatbed and roll" process/pattern is most preferred.

Fiber Interlock Test: The fiber interlock value is the maximum force in grams per unit fabric weight needed to pull apart a given sample between two hooks.

Samples are cut ½ inch by 1 inch (machine-direction or cross-direction), weighed, and marked with two points one-half inch apart symmetrically along the midline of the fabric so that each point is ¼ inch from the sides near an end of the fabric.

The eye end of a hook (Carlisle six fishhook with the barb ground off, or a hook of similar wire diameter and size) is mounted on the upper jaw of an Instron tester so that the hook hangs vertically from the jaw. This hook is inserted through one marked point on the fabric sample. The second hook is inserted through the other marked point on the sample, and the eye end of the hook is clamped in the lower jaw of the Instron. The two hooks are now opposed but in line, and hold the samples at one-half inch interhook distances.

The Instron tester is set to elongate the sample at one-half inch per minute (100% elongation per minute) and the force in grams to pull the sample apart is recorded The maximum load in grams divided by the fabric weight in grams per square meters is the single fiber interlock value.

The fabric of the invention preferably has a fiber interlock value of at least 15.

Entanglement Frequency/Completeness Tests: In these tests, nonwoven fabrics are characterized according to the frequency and completeness of the fiber entanglement in the fabric, as determined from strip tensile breaking data using an Instron tester.

Entanglement frequency is a measure of the frequency of occurrence of entanglement sites along individual lengths of fiber in the nonwoven fabric. The higher the value of entanglement frequency, the greater is the surface stability of the fabric, i.e., the resistance of the fabric to the development of piling and fuzzing upon repeated laundering.

Entanglement completeness is a measure of the proportion of fibers that break (rather than slip out) when a long wide strip is tested. It is related to the development of fabric strength.

Entanglement frequency and completeness are calculated from strip tensile breaking data, using strips of the following sizes:

| Strip Width (in.) | Instron Gage Length (in.) | Elongation Rate (in./min.) |
|---|---|---|
| 0.8 ("$w_0$") | 0 | 0.5 |
| 0.3 ("$w_1$") | 1.5 | 5 |
| 1.9 ("$w_2$") | 1.5 | 5 |

In cutting the strips from fabrics having a repeating pattern or ridges or lines or high and low basis weight, integral numbers of repeating units are included in the strip width, always cutting through the low basis weight proportion and attempting in each case to approximate the desired width closely. Specimens are tested using an Instron tester with standard rubber coated, flat jaw faces with the gage lengths and elongation rates listed above. Average tensile breaking forces from each width are correspondingly reported at $T_0$, $T_1$, and $T_2$. It is observed that:

$$\frac{T_2}{w_2} \geq \frac{T_1}{w_1} \geq \frac{T_0}{w_o}$$

It is postulated that the above inequalities occur because:

(1) there is a border zone of width D at the cut edges of the long gauge length specimens, which zone is ineffective in carrying stress; and (2) with zero gauge length, fibers are clamped jaw-to-jaw and ideally all fibers carry stress up to the breaking point, while with long gauge lengths, some poorly-entangled fibers slip out without breaking. A measure of the proportion of stress-carrying fibers is called C.

Provided that D is less than ½ $w_1$, then:

$$\frac{T_1}{w_1 - 2D} = \frac{T_2}{w_1 - 2D} = C\frac{T_0}{w_0}$$

and D and C are:

$$D = \frac{w_1 T_2 - w_2 T_1}{2(T_2 - T_1)}$$

$$C = \frac{T_2 - T_1}{w_2 - w_1} \times \frac{w_0}{T_0}$$

In certain cases D may be nearly zero and even a small experimental error can result in the measured D being negative. For patterned fabrics, strips are cut in two directions: A in the direction of pattern ridges or lines of highest basis weight (i.e., weight per unit area), and B in the direction at 90° to the direction specified in A. In unpatterned fabrics any two directions at 90° will suffice. C and D are determined separately for each direction and the arithmetic means of the values for both directions are determined separately for each direction and the arithmetic means of the values for both directions $\overline{C}$ and $\overline{D}$ are calculated. $\overline{C}$ is called the entanglement completeness.

When $\overline{C}$ is greater than 0.5, $\overline{D}$ is a measure of the average distance required for fibers in the fabric to become completely entangled so that they cannot be separated without breaking. When $\overline{C}$ is less than 0.5, it has been found that $\overline{D}$ may be influenced by factors other than entanglement. Accordingly, when $\overline{C}$ is less than 0.5, calculation of $\overline{D}$ as described above may not be meaningful.

From testing various samples, it is observed that the surface stability of a fabric increases with increasing product of $\overline{D^{-1}}$ and the square root of fiber denier d. Since 1.5 denier fibers are frequently used, all deniers are normalized with respect to 1.5 and entanglement frequency f per inch is defined as:

$$f=(\overline{D^{-1}}\sqrt{d}\sqrt{1.5})$$

If the fabric contains fibers of more than one denier, the effective denier d is taken as the weighted average of the deniers.

If the measured $\overline{D}$ turns out to be zero or negative, it is proper to assume that the actual $\overline{D}$ is less than 0.01 inch and f is therefore greater than $(100\sqrt{d}\sqrt{1.5})$ per inch.

The fabric of the invention preferably has a fiber entanglement frequency of f of at least 10.0, and a fiber interlock completeness of at least 1.00, and a fiber interlock value of at least 15.

As shown in Table 1, for the Spinlace™ fabrics of the invention the entanglement completeness values trend higher than for the hydroentangled staple fiber webs (HET). It is believed that these superior properties are a result of the complexity of the interengaged loop and spiral matrix formed by the continuous filaments. Grab tensile values for Spinlace™ are about two times that of the hydroentangled staple fiber webs. Trap tear values for all of the Spinlace™ fabrics exceed those of the traditional fabrics. It is believed that this is a result of the randomness of the fiber matrix of the Spinlace™ fabrics that confounds the fault lanes that more quickly lead to failures in this test for other fabrics. This is also further evidenced that the complex entangling of the continuous filaments of the Spinlace™ fabrics of the present invention comprises substantially superior and distinct mechanical bonding and disengagement from that of the traditional entangling of cut staple fibers.

Strip tensile values are highest for the Spinlace™ fabrics, regardless of sample basis weight. Note the novel high elongation values that are in combination with the high tensile of the Spinlace™. This is in agreement with the observations of the fabrics during testing. During testing, Spinlace™ fabric test samples were observed to initially resist the applied tensile stress, and then to gradually release the tension by disentanglement of the filament from the complex matrix structure. Tests of traditional fabrics, on the other hand, were observed to experience fiber and bond breakage, leading to shorter elongation values. As discussed infra, the concomitant high strength and high elongation of the fabric of the present invention represents an unexpected and novel property.

A further aspect of the present invention contemplates a process of making a laminated nonwoven fabric, wherein the fabric comprises plural laminations each comprising a web of substantially continuous polymeric thermoplastic filaments. As is characteristic of the fabrics discussed hereinabove, each of the web of the laminated nonwoven fabric is substantially free of filament ends intermediate end portions of the web. This aspect of the invention contemplates that adjacent ones of the webs of the laminated fabric can exhibit different properties. In particular, it is contemplated that the polymeric filaments of adjacent laminations of the fabric exhibit differing bonding temperatures, with hydroentanglement of the laminations acting to integrate and unify the laminations without resort to heat bonding or the like. The various lamination can therefore be selected for other desirable properties, such as softness, strength, etc., without specific concern regarding the compatibility of the various laminations for integration by heat bonding or similar processes.

Thus, this aspect of the invention contemplates manufacture of nonwoven fabric laminate with improved softness of hand produced by treating continuous filament webs with high pressure water jets. A relatively strong nonwoven fabric with improved softness and hand is produced through hydroentanglement of continuous filament layers. One layer of the fabric may comprise polyethylene filaments, while the second layer may comprise polyester, polypropylene, or a like filament that provides the resultant fabric with the desired strength. This aspect of the invention contemplates an improved nonwoven fabric comprising layers of polyethylene filament, and polypropylene, polyester, or a similar relatively stronger filament web. The webs are bonded together using high pressure water jets in accordance with processes disclosed hereinabove, including an arrangement such as disclosed in FIGS. 5A and 5B, wherein a secondary web is introduced in conjunction with formation of a primary web. A fabric embodying this aspect of the present invention is strong in comparison to a fabric having a similar weight comprising a 100% polyethylene web. The fabric is soft compared to similar basis weight fabrics made from 100% polypropylene, polyesters, or like polymers. The material embodying this aspect in the invention comprises plural laminations, and may comprise two laminations wherein a polyethylene filament layer presents a surface having hand similar to a 100% polyethylene web.

The present process contemplates that plural precursor webs are provided, wherein each of the precursor webs comprises substantially continuous polymeric thermoplastic filaments. If the present process is practiced in-line with an associated spunbonding apparatus, one or all of the plural precursor webs may be provided in the form of unbonded filaments. In contrast, at least one of the precursor webs may comprise spunbonded fabric including lightly thermally bonded filaments. A precursor web provided in this form is broken down into its constituent filaments under the influence of the high pressure hydroentangling water jets, which break the thermal bonds formed in the precursor web. The use of relatively lightly bonded precursor spunbond webs is presently preferred, since the action of the high pressure water jets on the lightly bonded web tends to break the web into its constituent filaments, without breaking of the filaments into relatively shorter length fiber-like elements.

Fabrics formed in accordance with this aspect of the present invention may be patterned or non-patterned. The percentage of the nonwoven fabric that is polyethylene is preferably about 40% to 90% by weight of the fabric, with 75% polyethylene being presently preferred. Basis weight of the nonwoven fabric can range from about 15 to 80 g/m$^2$, with the preferred basis weight being about 30 g/m$^2$. The filament of the polyethylene portion of the fabric can be varied from about 2 to 5, with 3.5 denier being presently preferred. The remainder of the fabric weight may comprise one or more laminations formed from filaments other than polyethylene, such as polyester, polypropylene, or other thermoplastic polymer filaments. The denier of the filaments of these one or more laminations of the fabric is preferably about 0.5 to 3, with a denier of 1.5 being presently preferred. The presently preferred polymer for the strengthening laminations is polypropylene.

In accordance with the processes disclosed hereinabove, precursor webs are treated on one or both sides with high pressure water jets. The degree of hydroentangling required is that corresponding to a level which is sufficient to laminate the plural webs together. Greater levels of hydroentangling energy are desirable to stabilize the surfaces of the laminations to prevent fuzziness in the resultant fabric.

EXAMPLE 1

A hydroentangling apparatus configured in accordance with the present disclosure included entangling manifolds having orifice jets each 0.0059 inches in diameter, spaced at 33.33 per inch along the length of the manifold. A 20×20 three-dimensional image transfer device was employed. A 17 g/m$^2$, 1.7 denier polypropylene filament web, and a nominal 27 g/m$^2$, nominally 3.5 denier polyethylene web were combined at a processing speed of 40 feet per minute. Entangling treatments consisted of three rows of orifices directed against the two precursor webs on one side of the webs. The entangling pressure of the three entangling manifolds of the apparatus were successively provided at 600, 2,000, and 3,000 psi for the orifice jets. Total energy input was 1.8 horsepower-hour/pound.

It is contemplated that the process of the present invention for manufacture of laminated nonwoven fabric can be practiced in different ways. The fabric can be produced by providing precursor webs which are unwound from rolls, and directed into an entangling system. Alternatively, one or more of the precursor webs may be manufactured in a continuous process from an associated spunbonding apparatus. It is presently preferred that lightly thermally point bonded precursor rolls, having the desired basis weight, be provided, with one layer comprising polyethylene. The precursor webs are unwound and subjected to hydroentanglement treatment. Thermal point bonds of the strengthening filament web should be sufficiently weak so as to break apart into filaments under the forces of the hydroentangling jets, rather than resulting in breakage of the substantially continuous filaments themselves. In a continuous process, a minimum of two extruding beams are required, one for the polyethylene filament web, and one for the associated strengthening polymeric filament precursor web. A single polymer extrusion system can be advantageously employed by using an un-winder, and introducing the second precursor web via unwinding.

As will be appreciated, more than two plural laminations can be provided for the present nonwoven fabric. By way of example, two polyethylene precursor webs, and one polypropylene precursor web, can be provided to produce a polyethylene/polypropylene/polyethylene laminated nonwoven fabric that has a soft feel on both of the exterior polyethylene surfaces. This type of product, exhibiting polyethylene on both of its exterior surfaces, can be advantageously employed in products requiring assembly bonding, such as disposable diapers. Finished products in accordance with the present invention are soft and pliable, in comparison to point bonded and latex bonded fabrics having the same basis weights.

A further aspect of the present invention discloses a process of making a highly durable, dyeable nonwoven fabric made of hydroentangled continuous filaments. The process employs spunbonded webs that are fully stabilized by thermal point bonding. High pressure water jets, as generally described hereinabove, are utilized to separate filaments from the thermal bond points, freeing the filaments from entangling by the water jets. The process advantageously employs multiple spunbond precursor webs or layers to form a composite web of substantial basis weight, up to 600 g/m$^2$. The resultant fabric is preferably produced form polyester (PET, polyethylene terephthalate) spunbond substrate. As a result, the fabrics are highly durable, and can be dyed in standard textile dyeing and finishing processes.

Thermally bonded spunbond layers, preferable comprising polyester, are employed as feedstock for a high-pressure hydroentangling process. The resultant fabric is a high basis weight nonwoven web, from 50 to 600 g/m$^2$, with the desirably uniform appearance and durability of a traditional woven or knitted textile of similar basis weight. The advantages of this process, and the resultant fabric, over other purportedly durable nonwoven webs include: the low cost of spunbond webs versus other nonwoven webs; the speed of the manufacturing process based on the ability to use highly stabilized (thermally point bonded) continuous filaments webs as feedstock; and the durability and dyeability of the finished nonwoven fabric, with the fabric exhibiting adequate strength at lower basis weights compared to standard textiles.

Advantages of the present process over traditional knitting and weaving processes include the low cost of the nonwoven feedstock, and the high speed of the spunbond and entangling processes, versus the speed of knitting or weaving looms. The basis weight of the final fabric product is controlled by the weight of the feedstock layer and the number of layers used.

Figure 9:
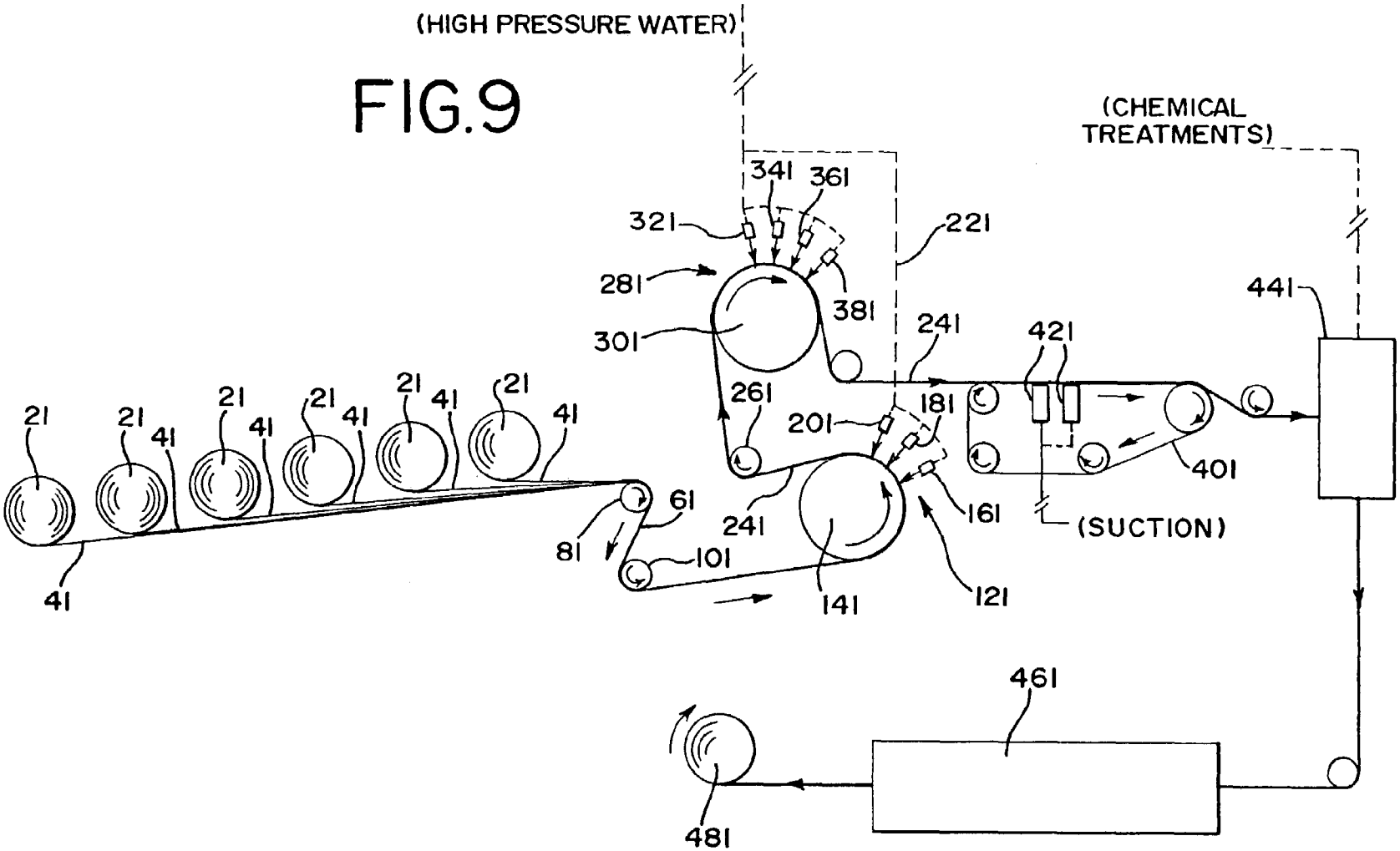
FIG. 9 is a schematic view of an apparatus for practicing a process further embodying the present invention, wherein plural precursor webs are employed for production of a nonwoven fabric.

FIG. 9 shows a series of in-line unwind rolls 21 for providing a plurality of superimposed layers 41 of spunbond fabric. The term "spunbond" is used herein refers to commercially available fabrics comprising thermally point bonded thermoplastic polymer continuous or endless filaments. As is well-known in the art, these fabrics are made by melting and continuously melt-extruding a thermoplastic polymer through a large number of small openings. The filaments are cooled and attenuated or elongated either mechanically or pneumatically, such as in a slot attenuator having a high flow of air, and are deposited on a porous moving conveyor, typically with the aid of suction beneath the conveyor in the area of deposit. Preferably, the filaments are uncrimped, since this may adversely affect subsequent processing. The web is then passed between heated calender rolls, one being engraved, to cause thermal point bonding of a portion of the intersecting filaments. The web, which is now cohesive and stable, can be wound up into rolls and/or slit. Slitting may be required, for example, if the width of the spunbonding apparatus is greater than the operational width of the hydroentanglement apparatus.

The basis weights of the individual spunbond webs 41 is not critical and is primarily selected to provide a resultant layered basis weight of the desired value, depending on the end use of the finished fabric. For example, for final basis weights of 50 to 100 g/m$^2$, the feedstock prebonded webs 41 can be in the order of 15 to 25 g/m$^2$. For finished products having a basis weight in excess of 100 g/m$^2$, heavier basis weight feedstock fabrics 4 may be used. For instance, webs of a basis weight of 50 to 75 g/m$^2$ may be used to produce final fabrics having a basis weight of 250 to 600 g/m$^2$.

The thermoplastic polymers employed to make the prebonded webs 41 may comprise polyolefins, polyamide, and polyesters, with polyesters most preferred. The preferred range of filament deniers is from about 0.2 to 3.0, with about 1.5 being most preferred.

The total point bonds of the precursor fabric 4 are important to allow handling and subsequent treatment. Thermal point bonds may be provided by a calender having spaced raised areas to provide a plurality of spaced bond points in the web with unbonded filaments therebetween. The total thermal bond points can occupy from 5% to 45% of fabric area, with 10% to 30% being most preferred. If the bonding is too low, the web will be unstable, and if the bonding is too high, the fabric becomes too stiff.

At least two layers of the prebonded spunbond fabric 41 are employed and unwound from rolls 21 as required. FIG. 1 illustrates a total of six fabrics 4 being dispensed from six rolls 21 for entanglement. Also, additional layers of prebonded layers of nonwoven fabrics or other types may be included such as meltblown webs and nonwoven fabrics made from staple fibers.

The individual spunbond webs 44 are layered or superimposed on one another to form unbonded laminate 61. Unbonded laminate 61 is passed over rollers 81 and 101 to at least one hydroentanglement stations, generally indicated at 121. With the exceptions noted herein, this station can be that shows and described in U.S. Pat. No. 5,674,587 and No. 3,485,705, incorporated herein by reference. Unbonded layer laminate web 61 may be supported on a flat porous moving surface but is preferably supported on a rotating porous drum 141 as shown.

As shown, drum 141 rotates in a counterclockwise direction. Drum 141 may be in the form of a relatively rigid woven wire screen or may be constructed from a solid cylindrical member which has been drilled to provide drainage openings. Drum 141 carries unbonded laminate 61 under at least one and preferably a plurality of waterjet stations 161, 181, and 201, in which fine columnar jets of water are impinged on the outwardly facing layer. The energy of these jets causes the thermal point bonds of the individual layers 41 to become substantially completely disrupted, thereby freeing the individual continuous filaments. The jest further cause the freed filaments from each of the layers to entangle with other freed filaments from others of the layers 41 to provide a final cohesive, uniform web resistance to delamination. Unlike conventional webs of loose fibers, the prebonded layers of filaments 41 are relatively dense and compact and have less void volume, providing for more efficient transfer of hydraulic energy.

As shown schematically, hydroentanglement apparatus 121 includes features well-known in the art, including a water supply line 221 for supplying water at high pressure to entangling jets 161, 181, and 201. Also, the interior of drum 141 may be provided with a suction zone beneath the drum surface to remove and recycle excess water (not illustrated).

The energy generated by each manifold or jet 161, 181, and 201 is proportional to the number of orifices per unit linear length, the pressure of the liquid in the manifold, and the volumetric flow; and is inversely proportional to the speed of passage and the weight of the fabric being produced. The distance between jets 161, 181, and 201 and the top surface of the fabric 41 is on the order of 0.5 to 3 inches, preferably 1 to 3 inches, the upper limit being dictated by the tendency of the jet stream to diverge and lose energy.

Since standard entanglement equipment is employed, many of the above parameters are known or fixed, and in the case of the present invention, the major parameters are jet pressures and jet orifice diameters for line speeds on the order of 125 meters per minute or greater.

The operating pressure of initial jet manifold 161 impinging the fabric layers 41 is greater than 1,500 psi and preferably greater than 2,000 psi, which is higher than prior art methods have allowed for. It has been surprisingly found that initial pressures of up to about 4,500 psi may be employed without any adverse effects. Such high pressures are believed to be possible due to the stable nature of thermally bond webs 41. It is also noted that if desired, a porous screen may be employed over the outwardly facing layer of the fabric to better hold the fabric against the drum, but this is not required.

If the desired final basis weight of the ultimate entangled fabric is on the order of 50 to 100 g/m$^2$, jet 16, 18, and 20 orifice diameter is preferably on the order of 0.005 to 0.006 inches. For heavier fabrics, orifice diameters are preferably greater. For example, for fabrics having a basis weight of 100 to 600 g/m$^2$, preferred orifice diameter is 0.008 to 0.009 inches are employed to provide a higher level of energy.

The initial high hydraulic pressure surprisingly does not cause any substantial breakage of the individual filaments, which would disadvantageously tend to cause loss of strength in the final composite. The high pressure, however, does cause substantially complete disruption of the thermal bond points, such that the fabrics are temporarily converted to webs of loose continuous filaments, while at the same time the filaments within each layer 41 and between the layers 41 are being entangled. Stated conversely, the thermal bond points hold the filaments in position to prevent excessive displacement during initial entanglement.

It is known that fabrics of the same basis weight having a small denier have a greater tensile strength than fabrics with a large denier. Thus, the present process can employ multiple layers of small denier prebond fabrics to produce higher basis weight entangled fabrics with exceptional strength.

It will be appreciated that the thermally point bonded, continuous filament fabrics, can vary in basis weight, filament denier, and degree of thermal point bonding. Various types of these fabrics can be employed as the initial feedstock 41 and may be used in a variety of combinations to provide special effects for end use applications. For example, a heavier fabric can be combined with a lighter fabric wherein the heavier fabric serves as a backing and the lighter fabric serves as a decorative or outwardly facing surface.

Although not essential, the layered and entangled fabric of the present invention is preferably subjected to hydroentanglement on both sides. If the fabric is subjected to entanglement on only one side, the side facing the drum or forming surface will generally have a lesser degree of entanglement and thus have lower abrasion resistance, although this is sometimes not an important factor.

As shown in FIG. 9, after exiting entanglement station 121, the resultant entangled and cohesive fabric web 241 may be fed around a lead roll 261 to treat its reverse side at a second hydroentangling station 281 comprising a porous drum 301, which in the embodiment shown, rotates in a clockwise direction. The station 281 includes at least one and preferably a plurality of water jet manifolds 321, 341, 361 and 381, spaced sequentially around a portion of the circumference of the roll. This step increases the degree of entanglement but also urges exposed loops of filaments back through the normal plane of the web 241. The jets 321-381 preferably operate at a higher pressure than the jets of the first series, preferably in excess of 3,000 psi and most preferably in excess of 4,500 psi. As discussed generally above, orifice size and operating pressures of jets at both entanglement stations 121 and 281 depend on substrate fabric basis weights, desired final fabric basis weight, and line speed.

The second forming drum 301 may be of the same general type as the first drum, or it may be different. In order to apply a variety of surface finishes, topography and appearances, it is possible to employ a drum or a roll which has a solid uneven surface, such as engraved or debossed areas. Planar and roll fabric forming devices of this nature are known in the art and may be employed, for example, to provide a fabric with apertures to resemble various types of woven fabrics, or a variety of surface textures in a three-dimensional pattern. The relevant methods and equipment requirements are shown and described in U.S. Pat. No. 5,244,711, No. 5,098,764, No. 5,674,587 and No. 5,674,591, incorporated herein by reference.

After the hydroentanglement treatment is completed, the web is transferred to a porous moving conveyor 401 and passed over suction boxes 421 to debater the web.

The web may then be passed through an optional treatment station 441 for the purpose of applying topical treatments, usually in liquid form, to the web. Various agents are known and can be applied, including flame retarding agents, agents to improve dyeablility, agents to improve softness, and agents to alter surface activity, such as repellants and surfactants. While curable binders can be applied, these are not required, and in many applications, the fabric is preferably free of binders. The web is then passed through a dryer 461 and wound up on a roll 481.

A significant advantage of the present invention is the ability to produce extremely durable nonwoven fabrics at a high basis weight range, in the order of 50 to 600 g/m$^2$.

The fabrics of the present invention can be converted into a wide variety of end use products, such as upholstery, apparel, pads, covers, and the like.

Figure 10:
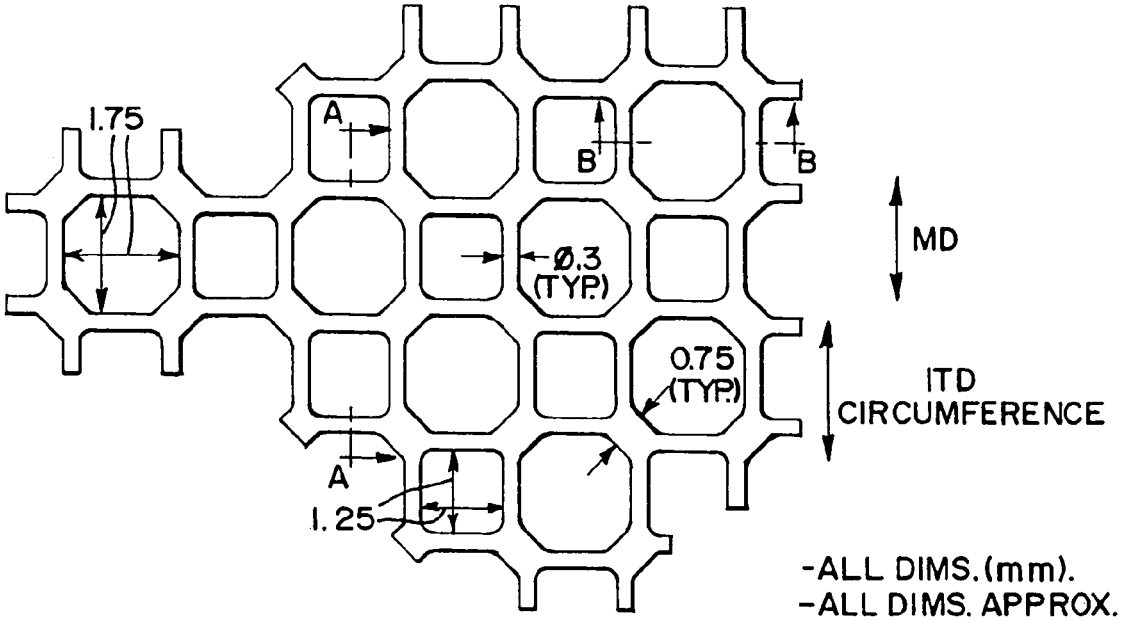
FIGS. 10 is a diagrammatic view of a three-dimensional image transfer device.
Figure 10A:
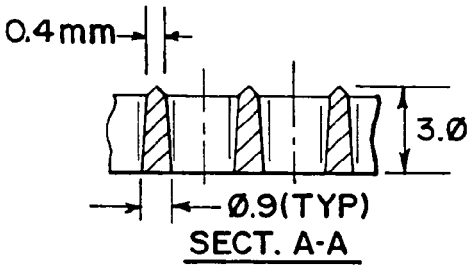
FIG. 10A is a cross-sectional view taken along lines A-A of FIG. 10.
Figure 10B:
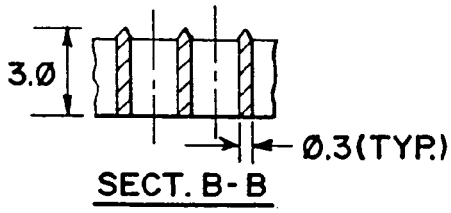
FIG. 10B is a cross-sectional view taken along lines B-B of FIG. 10.
Figure 10C:
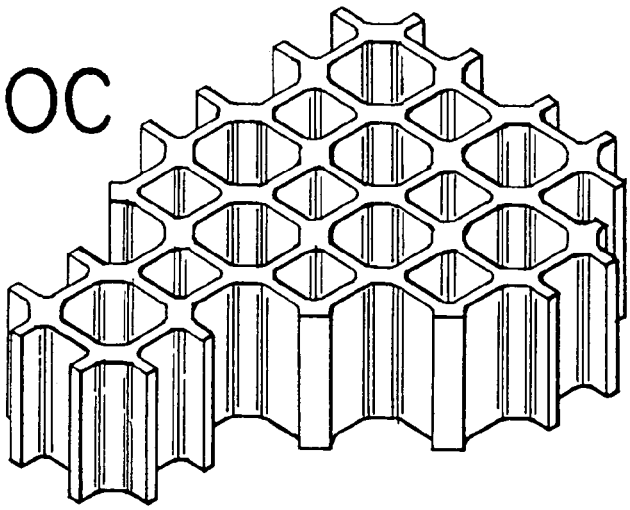
FIG. 10C is a perspective view of the three-dimensional image transfer device shown in FIG. 10.
Figure 11A:
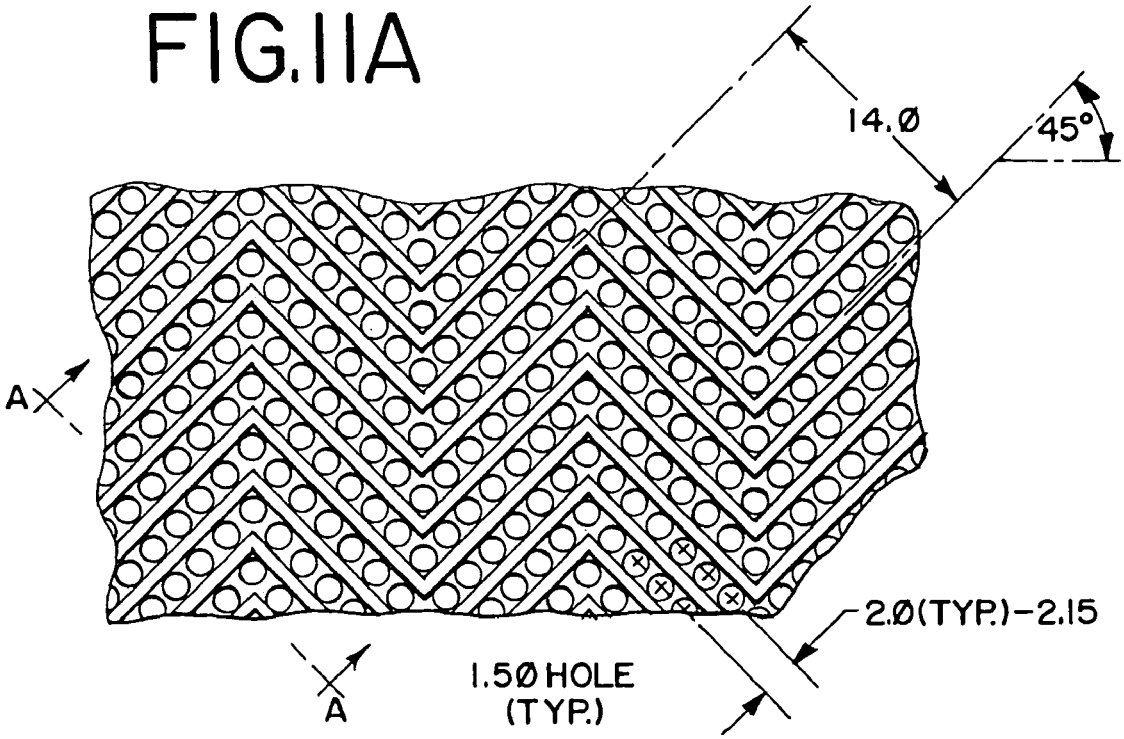
FIG. 11A is a diagrammatic view of a three-dimensional image transfer device.
Figure 11B:
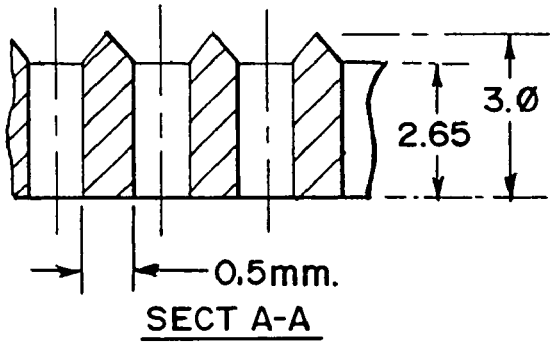
FIG. 11B is a cross-sectional view taken along lines A-A of FIG. 11.

In a preferred step of the process of the invention wherein polyester substrate webs 4 have been used, the resultant coherent web 241 of the invention may also be jet dyed (not illustrated) using modern jet dying techniques, which involve high liquid flow rates to obtain good uniformity and reduced dwell time. The following table illustrates the physical properties of three different polyester fabrics of the present invention before and after being subjected to jet dyeing. The "octagon/square" pattern is configured in accordance with FIGS. 10 to 10C, which illustrate a three-dimensional image transfer device. The "herringbone" pattern is configured in accordance with U.S. Pat. No. 5,736,219 to Suehr, hereby incorporated by reference, and as specifically configured in accordance with FIGS. 11 and 11A.

Effect of Jet Dyeing On Physical Properties

| Pattern | | Basis Wt. g/m$^2$ | Grab Tensile, kg | | Grab Elongation, % | |
|---|---|---|---|---|---|---|
| | | | MD | CD | MD | CD |
| Herringbone | Initial | 188 | 47 | 33 | 72.1 | 110 |
| | Post Jet-Dye Process | 234 | 53 | 34 | 67 | 125 |
| octagon/square | Initial | 140 | 33 | 21 | 61.7 | 125 |
| | Post Jet-Dye Process | 180 | 38 | 25 | 63 | 133 |
| octagon/square | Initial | 184 | 46 | 34 | 74.4 | 117 |
| | Post Jet-Dye Process | 229 | 53 | 34 | 70.5 | 123 |

From these examples, it will be noted that the basis weight of the fabric increased, which is presumably due to uptake of the dye and to some degree of fabric shrinkage. It is also noteworthy that the physical properties, especially the tensile strength values, show improvement.

Unlike hydroentangled fabrics of the prior art made from fibers, the fabrics of the present invention exhibit a unique physical structure and mechanical bonding mechanism. Microscopic examination of the fabric reveals that the thermal point bonds which existed in the original spunbond feedstock are substantially absent, and therefore, thermal bonds do not play a role in the strength of the fabric. Moreover, and somewhat surprisingly, the process of the invention does not cause significant breakage of the filaments themselves, such that they remain continuous. In addition, since the continuous filaments don't have loose ends which allows substantial mobility and substantial knotting and wrapping, the filaments through the process of the invention become arrange din a unique fashion. The resulting structure is in the form of a complex matrix of filament loops which are packed and are characterized by an absence of infra- and inter-filament knotting and wrapping. Since the matrix is continuous and interconnected throughout the fabric, the fabric is extremely durable.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A method of making a hydroentangled nonwoven fabric of continuous filaments, comprising the steps of:

a) superimposing at least two layers of continuous filaments spunbond fabrics, said fabrics bonded by thermal point bonds, supporting said layers on a three-dimensional image transfer device to form an unbonded laminate; and b) subjecting at least a first side of said laminate to fine water jets at high pressure, said water jets causing disruption of said thermal point bonds and causing the filaments of said at least two layers to become entangled to form a coherent final fabric.

2. A method of making a hydroentangled nonwoven fabric as in claim 1, wherein each of said layers have a basis weight of 15 to 100 g/m$^2$, and said coherent final fabric has a basis weight of between about 50 to 600 g/m$^2$.

3. A method of making a hydroentangled nonwoven fabric as in claim 1, wherein each of said layers have a basis weight of 50 to 75 g/m$^2$, and said coherent final fabric having a basis weight of 250 to 600 g/m$^2$.

4. A method of making a hydroentangled nonwoven fabric as in claim 1, wherein each of said layers have a basis weight of 15 to 25 g/m$^2$, and said coherent final fabric having a basis weight of 50 to 100 g/m$^2$.

5. A method of making a hydroentangled nonwoven fabric as in claim 1, wherein each of said layers comprise a member of the group consisting of polyolefins, polyamide, polyesters, and combinations thereof.

6. A method of making a hydroentangled nonwoven fabric as in claim 1, wherein each of said layers comprises polyesters.

7. A method of making a hydroentangled nonwoven fabric as in claim 1, wherein each of said layers comprise fibers of 0.2 to 3.0 denier.

8. A method of making a hydroentangled nonwoven fabric as in claim 1, wherein each of said layers have thermal bonds covering from 5% to 45% of layer area.

9. A method of making a hydroentangled nonwoven fabric as in claim 1, wherein each of said layers have thermal bonds covering from 10% to 30% of layer area.

10. A method of making a hydroentangled nonwoven fabric as in claim 1, wherein said coherent final fabric is substantially free of thermal bonds.

11. A method of making a hydroentangled nonwoven fabric as in claim 1, wherein said coherent final fabric is characterized by continuous filaments hydroentangled into an arrangement of packed loops and spirals that are substantially free of filament breakage and knotting.

12. A method of making a hydroentangled nonwoven fabric as in claim 1, further comprising hydroentangling at least an additional prebonded nonwoven web of staple fibers with said at least two spunbond layers.

13. A method of making a hydroentangled nonwoven fabric as in claim 1, wherein said image transfer device comprises a porous forming drum having a three-dimensional surface.

14. A method of making a hydroentangled nonwoven fabric as in claim 1, wherein said water jets operate at greater than 1,500 psi pressure.

15. A method of making a hydroentangled nonwoven fabric as in claim 1, wherein said water jets operate at greater than 2,000 psi pressure.

16. A method of making a hydroentangled nonwoven fabric as in claim 1, wherein said water jets operate at about 4,500 psi pressure.

17. A method of making a hydroentangled nonwoven fabric as in claim 1, wherein said layers are hydroentangled at a rate of at least 125 m/min.

18. A method of making a hydroentangled nonwoven fabric as in claim 1, further comprising the step of subjecting a second side of said laminate to fine water jets operating at high pressure.

19. A method of making a hydroentangled nonwoven fabric as in claim 1, wherein each of said layers comprise polyester, and the method further comprises the step of jet dyeing said coherent final fabric.

20. A method of making hydroentangled nonwoven fabric of continuous filaments, comprising the steps of:

a) superimposing at least a first and a second layer of continuous filament spunbond fabrics, said fabrics bonded by thermal point bonds, said fabrics comprising polyester filaments of about 0.2 to 3.0 denier, said layers each having a basis weight of between about 15 to 100 $g/m^2$, supporting said layers on a three-dimensional image transfer device to form an unbonded laminate;

b) subjecting a first side of said laminate to fine water jets operating at a pressure of at least 1,500 psi, subjecting a second side of said laminate to fine water jets operating at a pressure of at least 3,000 psi, said water jets causing disruption of substantially all of said thermal point bonds and causing the filaments of said at least two layers to become entangled and to form a coherent final fabric having a basis weight of between about 50 to 600 $g/m^2$, said coherent final fabric characterized by an arrangement of packed loops and spirals subsequently free of filament breakage and knotting; and jet dyeing said final coherent fabric.

* * * * *